US005577670A

United States Patent [19]

Omata et al.

[11] Patent Number: 5,577,670

[45] Date of Patent: Nov. 26, 1996

[54] PNEUMATIC IMPACT PULVERIZER SYSTEM

[75] Inventors: Kazuhiko Omata, Satte; Hitoshi Kanda, Yokohama; Momosuke Takaichi, Nagareyama; Satoshi Mitsumura, Yokohama; Kazuyuki Miyano, Tokyo, all of Japan

[73] Assignee: Canon Kabushiki Kaisha, Tokyo, Japan

[21] Appl. No.: 375,173

[22] Filed: Jan. 18, 1995

Related U.S. Application Data

[63] Continuation of Ser. No. 912,695, Jul. 13, 1992, abandoned.

[30] Foreign Application Priority Data

| | | | |
|---|---|---|---|
| Jul. 16, 1991 | [JP] | Japan | 3-199901 |
| Jul. 16, 1991 | [JP] | Japan | 3-199902 |
| May 8, 1992 | [JP] | Japan | 4-116176 |

[51] Int. Cl.[6] ..... B02C 23/00; B02C 23/26

[52] U.S. Cl. ..... 241/5; 241/40

[58] Field of Search ..... 241/5, 39, 40, 241/29, 152.1, 80

[56] References Cited

U.S. PATENT DOCUMENTS

| | | | |
|---|---|---|---|
| 3,614,600 | 10/1971 | Blythe | 241/5 |
| 4,304,360 | 12/1981 | Luhr et al. | 241/5 |
| 4,930,707 | 6/1990 | Oshiro et al. | 241/40 |
| 5,016,823 | 5/1991 | Kato et al. | 241/5 |

FOREIGN PATENT DOCUMENTS

| | | |
|---|---|---|
| 0417561 | 3/1991 | European Pat. Off. . |
| 54-42141 | 4/1979 | Japan . |
| 55-18656 | 2/1980 | Japan . |
| 1148740 | 6/1989 | Japan . |
| 1254266 | 10/1989 | Japan . |

OTHER PUBLICATIONS

Section PO, Week 8942, Derwent Publications Ltd., London, GB (Nov. 29, 1989).

*Primary Examiner*—Douglas D. Watts

*Attorney, Agent, or Firm*—Fitzpatrick, Cella, Harper & Scinto

[57] ABSTRACT

A pneumatic pulverizer comprises an accelerating tube for carrying and accelerating powder to be pulverized with high-pressure gas and a pulverizing chamber for pulverizing the powder to be pulverized. The back end of the accelerating tube is provided with a pulverization powder feed port for feeding powder to be pulverized to the accelerating tube, the pulverizing chamber has an impact member having an impact surface opposed to the opening plane of the outlet of the accelerating tube, and a side wall against which the powder to be pulverized that has been pulverized by the impact member collides to further pulverize. The closest distance from the side wall to a margin of the impact member is shorter than the closest distance from the front wall of the pulverizing chamber opposed to the impact surface to the margin of the impact member to prevent pulverized powder from fusing, coagulating, and getting coarser, and prevent localized abrasion of an impact surface the impact member and the accelerating tube.

65 Claims, 14 Drawing Sheets

PNEUMATIC IMPACT PULVERIZER SYSTEM

This application is a continuation of application Ser. No. 07/912,695, filed Jul. 13, 1992, now abandoned.

BACKGROUND OF THE INVENTION

1. Field of the Invention

The present invention relates to a pneumatic impact pulverizer using high-pressure gas in the form of a jet stream, a fine powder production apparatus having a pneumatic classifying means and a pneumatic impact pulverizing means designed for pulverization using high-pressure gas, and a process for producing toner for developing electrostatic images.

2. Related Background Art

A pneumatic impact pulverizer using high-pressure gas in the form of a jet stream carriers raw powder material with the jet stream, and ejects the raw material from the outlet of an accelerating tube so that the raw material will collide against the impact surface of an impact member that is opposed to the opening plane of the outlet of the accelerating tube. This induces impact force and thereby pulverizes the raw powder material.

For example, in a pneumatic impact pulverizer shown in FIG. 23, an impact member 43 is opposed to an outlet 45 of an accelerating tube 46 to which a high-pressure gas feed nozzle 47 is connected. High-pressure gas supplied to the accelerating tube 46 attracts raw powder material into the accelerating tube 46 through a raw powder material feed port formed in the middle of the accelerating tube 46. Then, the raw powder material is ejected together with the high-pressure gas to collide with an impact surface of the impact member 43. The impact pulverizes the raw powder material.

In the pneumatic impact pulverizer shown in FIG. 23, a pulverization powder feed port 40 is formed in the middle of the accelerating tube 46. Therefore, the powder to be pulverized that has been attracted to the accelerating tube 46 rapidly changes its route towards the outlet of the accelerating tube due to a high-pressure air current ejected through a high-pressure gas supply nozzle 47 immediately after passing through the pulverization powder feed port 40. While changing the route, the powder to be pulverized is dispersed in the high-pressure air current and accelerated quickly. In this state, relatively coarse particles of the powder to be pulverized are involved in the portion of the high-pressure air current that is flowing at a lower flow velocity in the accelerating tube, because of the influence of inertial force. Relatively fine particles are involved in the portion of the high-pressure air current flow that is flowing at a higher flow velocity in the accelerating tube. Thus, the particles are not dispersed uniformly within the high-pressure air current. Therefore, the high-pressure current remains separated into a flow having higher concentration of power to be pulverized and a flow having lower concentration of powder to be pulverized. Then, when the high-pressure air current collides with an opposed impact member together with the powder to be pulverized, the powder to be pulverized concentrates on part of the impact member. This deteriorates pulverization efficiency and degrades throughput.

In the vicinity of an impact surface 41, dust concentration is likely to increase because of the presence of powder to be pulverized and pulverized powder. If the powder to be pulverized contains a resin or other material having a low fusion point, the powder to be pulverized may fuse, become coarser, and coagulate. If the powder to be pulverized is abrasive, the impact surface of an impact member or the accelerating tube may suffer from powder abrasion. This results in frequent replacement of the impact member. There remain some problems that must be overcome to ensure continuous stable production.

Japanese Patent Application Laid-Open No. 1-254266 has proposed a pulverizer in which the tip of an impact surface of an impact member has a conical shape with an apex angle of 110° to 175°. Japanese Patent Application Laid-Open No. 1-148740 has described a pulverizer whose impact surface is formed as an impact plate having a projection on a plane perpendicular to an extension of the center axis of an impact member. These pulverizers successfully suppresses a localized rise of dust concentration in the vicinity of the impact surface. Therefore, pulverized powder is less likely to fuse, become coarser, and coagulate. Pulverization efficiency has improved, out a more significant breakthrough is desirable.

A variety of pneumatic classifiers have been proposed in the past. These pneumatic classifiers are combined with pneumatic impact pulverizers to form fine powder production systems. A typical system is, as shown in FIG. 24, a dispersion separator (manufactured by Japan Pneumatic Industries Co., Ltd. ).

A powder material feeder for feeding powder to a classifying chamber 64 of the foregoing pneumatic classifier shown in FIG. 24 is shaped like a cyclone. A guide chamber 62 is resting upright on the center of the top of an upper cover 70. A feed pipe 63 is connected to the outer circumferential surface of the upper part of the guide chamber 62. The feed pipe 63 is connected in such a manner that supplied powder will head for the circumferential tangent of the guide chamber.

In the pneumatic classifier shown in FIG. 24, a classifying louver 65 is arranged in the circumferential direction in the lower part of a body casing 71. Classification air that brings a whirling stream from outside to the classifying chamber 64 enters through the classifying louver 65.

A conical (bevel) classifying plate 67 having its center swelled is installed on the bottom of the classifying chamber 64. As coarse powder discharge opening 66 is formed along the outer circumference of the classifying plate 67. A fine powder discharge chute 68 is connected to the center of the classifying plate 67. The lower end of the fine powder discharge chute 68 is bent in the shape of an L. The bending end portion is located outside the side wall of the lower casing 72. The fine powder discharge chute 68 is connected to a suction fan via a cyclone, dust collector, or other fine powder collecting means. The suction fan induces suction force in the classifying chamber 64. With the suction force, suction air entering the classifying chamber 64 via the apertures of the louver 65 develops a whirling stream required for classification.

On feeding powder material to the guide chamber 62 through the feed pipe 63, the powder material whirls down on the inner circumferential surface of the guide chamber 62. Since the powder material descends in the form of a band from the feed pipe 63 along the inner circumferential surface of the guide chamber 62, distribution and concentration of powder material entering the classifying chamber 64 is not uniform (because powder material enters the classifying chamber while flowing on part of the inner circumferential surface of a guide cylinder). Poor dispersion ensues.

Higher throughput tends to result in further coagulation of powder material and insufficient dispersion. This cripples high-precision classification. When an amount of air for carrying powder material is large, enormous air flows into the classifying chamber. Accordingly, the center-oriented velocities of whirling particles in the chamber increase. Consequently, the diameters of separated particles become larger.

Therefore, in efforts to reduce the diameter of a separated particle, a damper 61 is usually placed on the top of the guide chamber to control an amount of air. When a quantity of deaeration is large, part of powder material is discharged and, therefore, lost.

In recent years, copying machines and printers have been required to offer higher image quality and precision. With this trend, required performance of toner serving as a developer has been evaluated more severely. Particles of toner become smaller. There is a demand for toner showing a sharp distribution of particle sizes; that is, a distribution of particles including no coarse particles and less very fine particles.

According to a general process of producing toner for developing electrostatic images, various colorants for producing toner colors, a charge control agent for applying electric charges to toner particles, in a single-component developing method disclosed in Japanese Patent Laid-Open Nos. 54-42141 and 55-18656, various magnetic materials for improving the capability of toner of being carried, and, if necessary, a parting agent and a fluidity facilitator are mixed in a dry process. Using a rolling-mill, extruder, or other kneader, the mixture is melted and kneaded. Then, the kneaded mixture is cooled and caked. Then, a jet stream pulverizer, a mechanical impact pulverizer, or other pulverizer is used to pulverize the caked mixture. A pneumatic classifier is used to classify the pulverized powder. Thus, the particles of the powder are down-sized to have a weight-average particle diameter of 3 to 20 μm that is suitable for toner. Then, if necessary, a fluidity agent or a lubricant is mixed to complete toner. For a double-component developing method, the toner is mixed with various magnetic carriers and supplied for image formation.

As described above, fine toner particles have been produced wholly or partly using the process represented as the flow chart of FIG. 25.

Coarsely-pulverized toner powder is fed continuously or sequentially to a first classifying means, and classified. Coarse powder composed mainly of coarse particles that are larger than a specified size is fed to a pulverizing means, and pulverized. Then, the pulverized powder is fed back to the first classifying means.

A finely-pulverized toner product composed mainly of other particles within or smaller than the specified size is fed to a second classifying means and classified into middle-sized powder composed mainly of particles having the specified size and fine powder composed mainly of particles smaller than the specified size.

Various pulverizers can be employed as the pulverizing means. When coarsely-pulverized powder whose main component is a binder resin is concerned, a jet stream pulverizer using a jet stream shown in FIG. 23, especially, a pneumatic impact pulverizer is employed. As described previously, the pulverizer shown in FIG. 23 offers poor pulverization efficiency and low throughput.

A classifier used as the first classifying means may be a rotor classifier in which classifying brades rotate to develop a whirling stream forcibly and thus performs classification, or a spiral pneumatic classifier that uses an air current taken in from outside to produce a whirling stream and thus performs classification. For classifying toner whose main component is a binder resin, the spiral pneumatic classifier is preferred because of its design in which a smaller movable section is brought into contact with powder.

As described previously, powder material (toner powder) comes out of a feed pipe 63 and descends in the form of a band along the inner circumferential surface of a guide cylinder 62. Powder material (toner powder) entering a classifying chamber 64 is not uniform in distribution and concentration. The powder material (toner powder) flows only along part of the inner circumferential surface of a guide cylinder and flows into the classifying chamber. Therefore, the powder material disperses poorly. When throughput is enhanced, powder material tends to coagulate more frequently and disperses insufficiently. Classification precision deteriorates. A finely-pulverized toner product fails to provide sharp distribution of particle sizes. The distribution becomes broad, the toner quality degrades, and the yield decreases.

SUMMARY OF THE INVENTION

The object of the present invention is to provide a pneumatic impact pulverizer, a fine powder production apparatus, and a process of producing toner for developing electrostatic images that have solved the aforesaid problems.

Another object of the present invention is to provide a pneumatic impact pulverizer capable of pulverizing powder to be pulverized efficiently and a fine powder production apparatus.

Another object of the present invention is to provide a pneumatic impact pulverizer capable of preventing fusion and coagulation of pulverized powder, and a fine powder production apparatus.

Another object of the present invention is to provide a pneumatic impact pulverizer capable of preventing generation of coarse particles and a fine powder production apparatus.

Another object of the present invention is to provide an pneumatic impact pulverizer capable of preventing localized abrasion of an impact surface of an impact member and of an accelerating tube, and a fine powder production apparatus.

Another object of the present invention is to provide a fine powder production apparatus capable of offering high pulverization efficiency in pulverizing powder to be pulverized and producing finely-pulverized powder showing sharp distribution of particle sizes.

Another object of the present invention is to provide a process of producing toner for developing electrostatic images that shows fine distribution of particle sizes.

Another object of the present invention is to provide a process of efficiently producing toner for developing electrostatic images.

Another object of the present invention is to provide a pneumatic pulverizer comprising an accelerating tube for carrying and accelerating powder to be pulverized with high-pressure gas and a pulverizing chamber for pulverizing the powder to be pulverized, wherein the back end of the accelerating tube is provided with a pulverization powder feed port for feeding powder to be pulverized to the accelerating tube;

the pulverizing chamber is equipped with an impact member having an impact surface opposed to the opening plane of the outlet of the accelerating tube;

the pulverizing chamber has a side wall against which the powder to be pulverized that has been pulverized with the impact member collides to further pulverize; and the closest distance from the side wall to a margin of the impact member, $L_1$, is shorter than the closest distance from the front wall of the pulverizing chamber opposed to the impact surface of the margin of the impact member, $L_2$.

Another object of the present invention is to provide a fine powder production apparatus comprising a pneumatic classifying means and a pneumatic impact pulverizing means, wherein:

the pneumatic classifying means has a powder feed pipe and a classifying chamber; a guide chamber communicating with the powder feed pipe is installed on the top of the classifying chamber; a plurality of introduction louvers are placed between the guide chamber and classifying chamber so that powder is introduced from the guide chamber to the classifying chamber together with carrier air via the apertures of the introduction louvers; a classifying plate having its center swelled is installed on the bottom of the classifying chamber; the side wall of the classifying chamber is provided with a classifying louver so that powder fed with carrier air is whirled in the classifying chamber together with air entering through the apertures of the classifying louver and classified into fine powder and coarse powder by means of centrifugation; a fine powder discharge port for discharging the classified fine powder is formed in the center of the classifying plate and connected to a fine powder discharge chute; a coarse powder discharge opening for discharging the classified coarse powder is formed along the outer circumference of the classifying plate;

a communicating means is provided to feed discharged coarse powder to the pneumatic impact pulverizing means; and the pneumatic impact pulverizing means has an accelerating tube for carrying and accelerating coarse powder fed with high-pressure gas and a pulverizing chamber for pulverizing coarse powder; the back end of the accelerating tube is provided with a coarse powder feed port for feeding coarse powder to the accelerating tube; the pulverizing chamber is equipped with an impact member having an impact surface opposed to the opening plane of the outlet of the accelerating tube; and the pulverizing chamber has a side wall against which coarse powder of pulverized powder that has been pulverized with the impact member collides to further pulverize; and the closest distance between the side wall and a margin of the impact member, $L_1$, is shorter than the closest distance between the front wall of the pulverizing chamber opposed to the impact surface and the margin of the impact member $L_2$.

Another object of the present invention is to provide a process for producing toner, comprising:

a step of melting and kneading a mixture containing at least a binder resin and a colorant, a step of cooling a kneaded mixture, a step of pulverizing a cooled mixture using a pulverizing means and producing pulverized powder, a step of classifying the pulverized powder into coarse powder and fine powder using a pneumatic classifying means, a step of further pulverizing the classified coarse powder using a pneumatic impact pulverizing means and producing fine powder material, a step of classifying the produced fine powder material using the pneumatic classifying means to produce fine powder, and a step of using the classified fine powder to produce toner for developing electrostatic images, wherein, the pneumatic classifying means has a powder feed pipe and a classifying chamber; a guide chamber communicating with the powder feed pipe is formed in the upper part of the classifying chamber; a plurality of introduction louvers are placed between the guide chamber and classifying chamber so that powder is introduced from the guide chamber to the classifying chamber together with carrier air via the apertures of the introduction louvers; a classifying plate having its center swelled is installed on the bottom of the classifying chamber; the side wall of the classifying chamber is provided with a classifying louver so that powder fed with the carrier air is whirled in the classifying chamber together with air flowing through the apertures of the classifying louver and classified into fine powder and coarse powder by means of centrifugation; a fine powder discharge port for discharging the classified fine powder is formed in the center of a classifying plate and connected to a fine powder discharge chute; and a coarse powder discharge opening for discharging the classified coarse powder is formed along the outer circumference of the classifying plate; discharged coarse powder is fed to the pneumatic impact pulverizing means; and the pneumatic impact pulverizing means has an accelerating tube for carrying and accelerating coarse powder fed with high-pressure gas and a pulverizing chamber for pulverizing coarse powder; the back end of the accelerating tube is provided with a coarse powder feed port for feeding coarse powder to the accelerating tube; the pulverizing chamber is equipped with an impact member having an impact surface opposed to the opening plane of an accelerating tube outlet; and the pulverizing chamber has a side wall against which coarse powder of pulverized powder that has been pulverized with the impact member collides to further pulverize, the closest distance between the side wall and a margin of the impact member, $L_1$, being shorter than the closest distance between the front wall of the pulverizing chamber opposed to the impact surface and the margin of the impact member, $L_2$, and in the pulverizing chamber, pulverization of coarse powder and further pulverization of the pulverized coarse powder are carried out with the impact surface of the impact member and the side wall.

DETAILED DESCRIPTION OF THE PREFERRED EMBODIMENTS

The present invention will be described more specifically.

Embodiment 1

FIGS. 1 to 6 are explanatory diagrams for an embodiment (Embodiment 1) of a pneumatic impact pulverizer according to the present invention.

Figure 1:
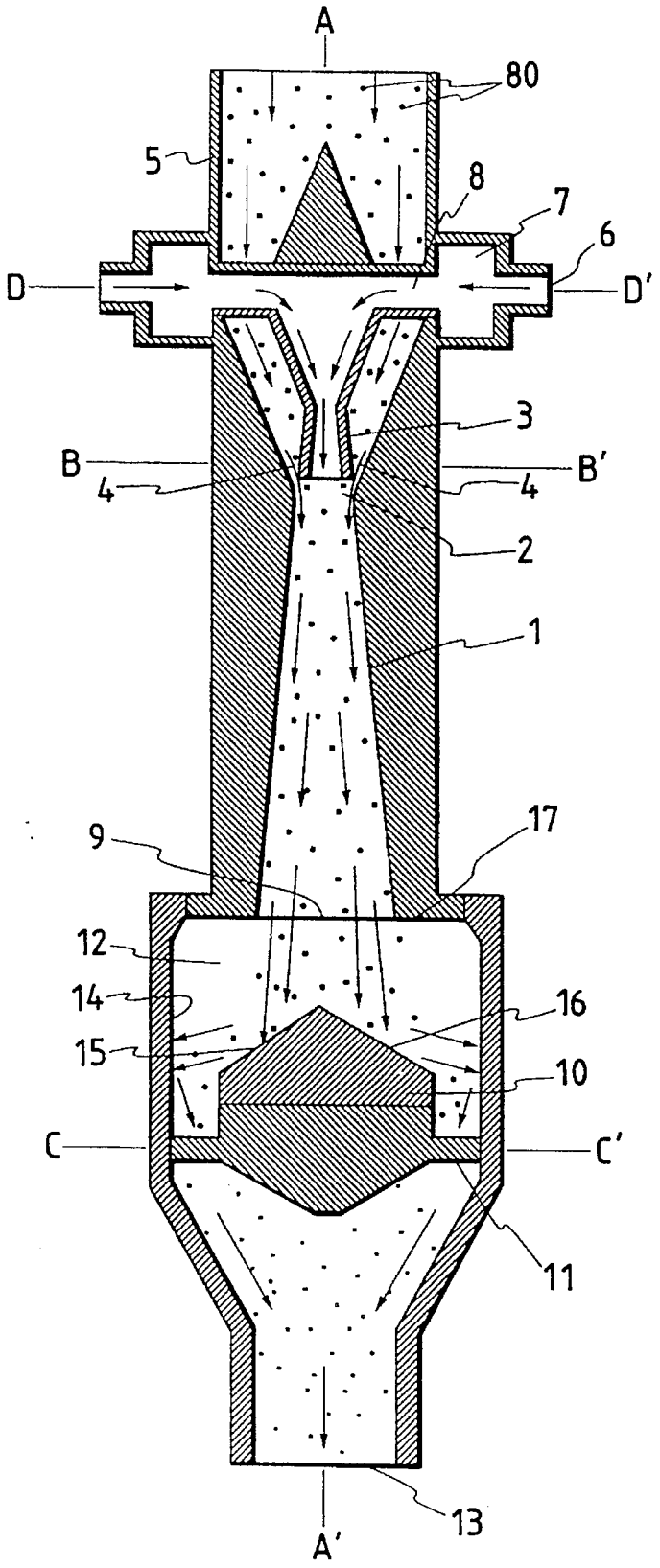
FIG. 1 shows an outline cross-section of an embodiment of a pneumatic impact pulverizer according to the present invention.

In FIG. 1, powder to be pulverized 80 fed through a pulverization powder feed pipe 5 passes through a pulverization powder feed port 4 (throat) formed between the inner wall of an accelerating tube throat 2 of an accelerating tube 1 and the outer wall of a high-pressure gas ejection nozzle 3, then enters the accelerating tube 1.

It is preferred that the center axis of the high-pressure gas ejection nozzle 3 be substantially aligned with the center axis of the accelerating tube 1.

On the other hand, high-pressure gas, which is fed through high-pressure gas feed ports 6, should, preferably, pass high-pressure gas chambers 7 through multiple high-pressure gas introduction pipes 8, enter the high-pressure gas ejection nozzle 3, then expand rapidly and eject toward an accelerating tube outlet 9. At this time, an ejector effect arises in the vicinity of the accelerating tube throat 2. Owing to the ejector effect, the powder to be pulverized 80 is accompanied by gas coexistent with the powder to be pulverized 80 and ejected from the pulverization powder feed port 4 toward the accelerating tube outlet 90. At this time, the powder to be pulverized 80 is uniformly mixed with high-pressure gas at the accelerating tube throat 2, accelerated quickly, then collided with an impact surface 16 of an impact member 10 opposed to the accelerating tube outlet 9 in the state of a uniform solid-gas mixed stream without a variation in dust concentration. Impact force occurring at the time of the collision is applied to individual particles (powder to be pulverized 80) that have been dispersed thoroughly. Thus, pulverization is performed very efficiently.

The pulverized powder that has been pulverized with the impact surface 16 of the impact member 10 comes into secondary collision (or third collision) with the side wall 14 of a pulverizing chamber 12, then goes out of a pulverized powder discharge port 13 formed behind the impact member 10.

Figure 21:
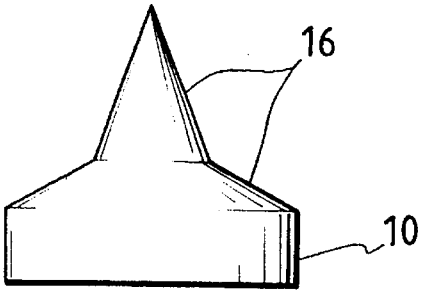
FIG. 21 is a front view of a conical impact member having a projection in the center.
Figure 22:
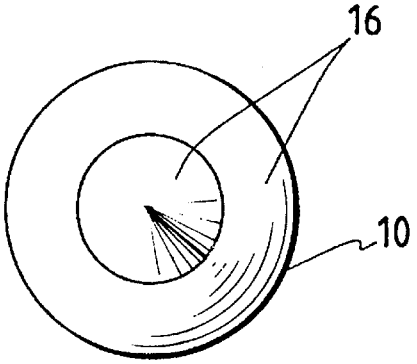
FIG. 22 is a plan view of a conical impact member having a projection in the center.

Preferably, the impact surface 16 of the impact member 10 should have a conical shape as shown in FIG. 1 or a conical projection as shown in FIGS. 21 and 22. This is because the conical shape or conical projection facilitates uniformity in dispersion of pulverized powder in the pulverizing chamber 12 and efficiency in secondary collision with the side wall 14. The structure having the pulverized powder discharge port 13 located behind the impact member enables smooth discharge of pulverized powder.

Figure 2:
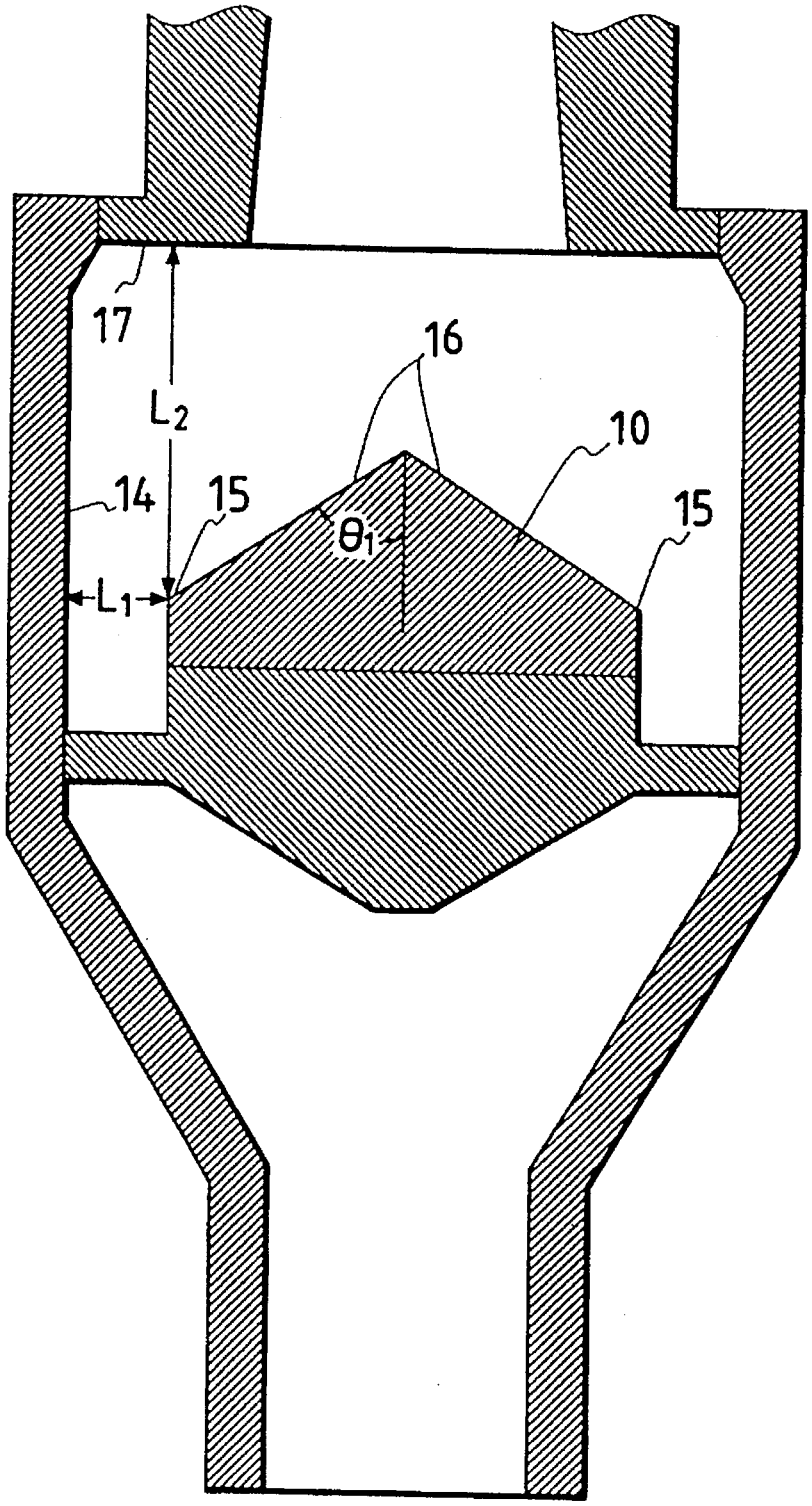
FIG. 2 is an enlarged view of a pulverizing chamber shown in FIG. 1.

FIG. 2 is an enlarged view of a pulverizing chamber. In FIG. 2, the closest distance from a margin 15 of an impact member 10 to a side wall 14, $L_1$, must be shorter than the closest distance from a front wall 17 to the margin 15 of the impact member 10, $L_2$. This is very important for successful suppression of powder concentration in a pulverizing chamber in the vicinity of an accelerating tube outlet 9. Since the closest distance $L_1$ is shorter than the closest distance $L_2$, pulverized powder can efficiently come into secondary collision with the side wall. The impact member 10 should, preferably, have an impact surface including a plane that is inclined by $\theta_1$ smaller than 90° (more preferably, 55° to 87.5°, or further more preferably, 60° to 85°) with respect to the longitudinal axis of the accelerating tube. The slope assists in dispersing pulverized powder uniformly and facilitates efficiency in secondary collision with the side wall 14.

Figure 23:
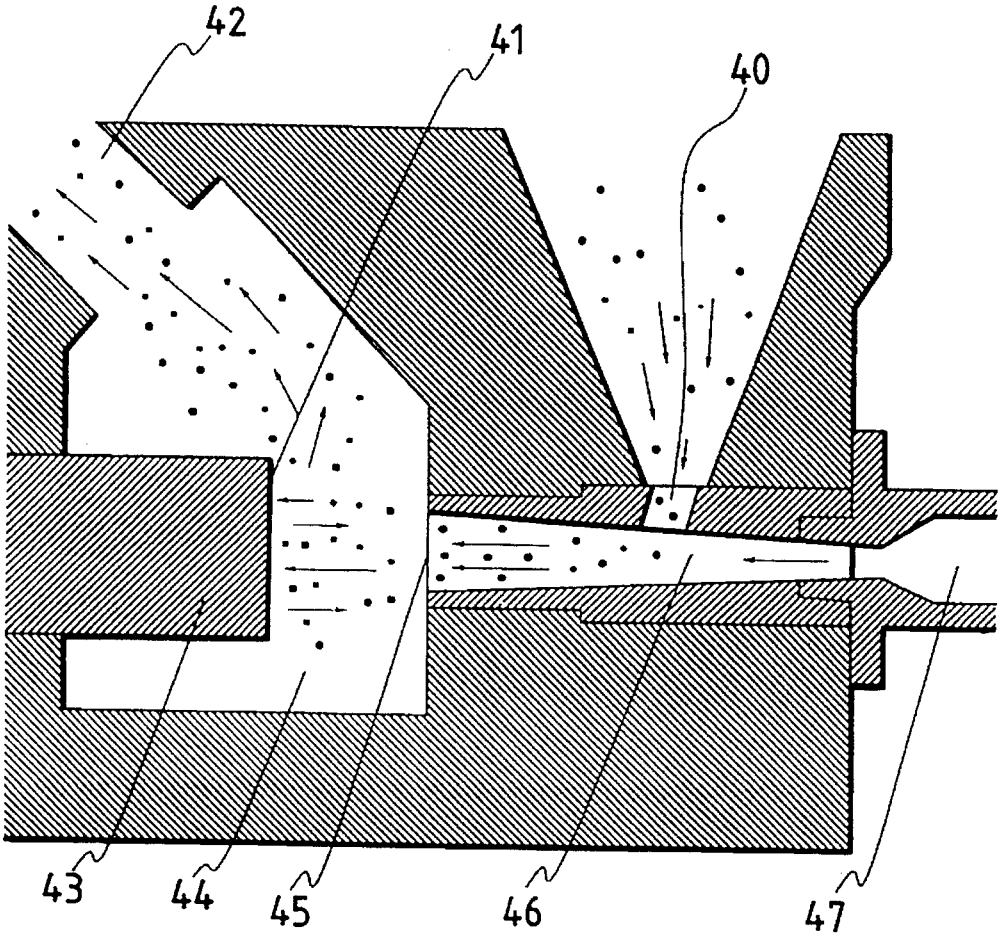
FIG. 23 shows an outline cross-section of a conventional pneumatic impact pulverizer.

In a pulverizer shown in FIG. 23, an impact member has an impact surface 41 or a plane standing perpendicularly to an accelerating tube 46. Compared with this pulverizer, a pulverizer having an inclined impact surface seldom causes powder to be pulverized or powder composed of a resin or an adhesive material to fuse, coagulate, or get coarser. This enables pulverization at a high dust concentration. Even when abrasive powder is to be pulverized, abrasion occurring on the inner wall of the accelerating tube or the impact surface of an impact member will not concentrate regionally. This further extends the service life of the pulverizer and realizes stable operation.

The longitudinal axis of an accelerating tube 1 should, preferably, be inclined by 0° to 45° with respect to the vertical axis. Within this range, powder to be pulverized 80 will not block a pulverization powder feed port 4.

When a pulverization powder feed pipe 5 has a conical member on the bottom, a small amount of powder to be pulverized or powder with poor fluidity may stagnate around the lower part of the conical member. In this case, the slope of the accelerating tube 1 should range from 0° to 20° (more preferably, 0° to 5°) with respect to the vertical axis. Thus, the powder to be pulverized will not stagnate around the lower part of the conical member but enter the accelerating tube smoothly.

Figure 5:
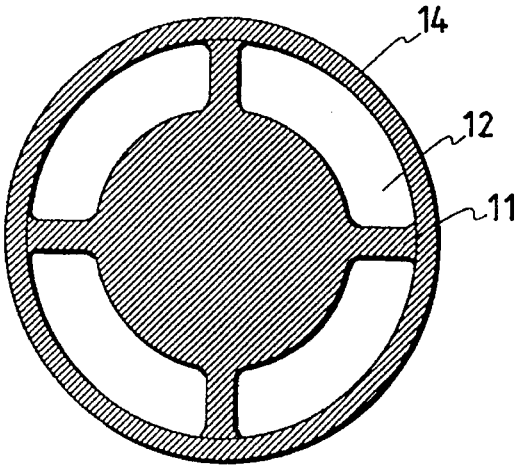
FIG. 5 shows a C—C' cross-section of FIG. 1.

The side wall of a classifying chamber should, preferably, have a substantially circular or elliptic cross section as shown in FIG. 5 on the C—C' line of FIG. 1. This facilitates uniform pulverization and smooth discharge of pulverized powder.

Figure 3:
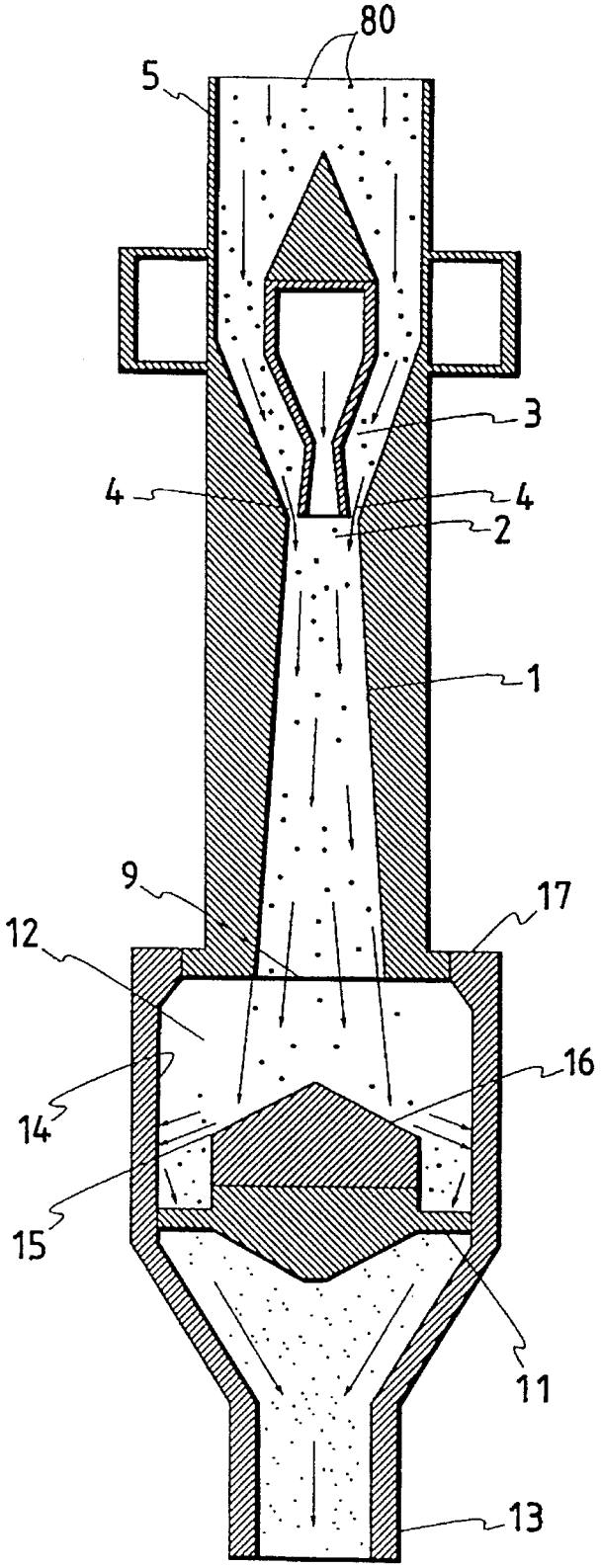
FIG. 3 shows an A—A' cross-section of FIG. 1.

FIG. 3 shows an A—A' cross section of FIG. 1. FIG. 3 helps understand the mechanism that powder to be pulverized 80 is fed to an accelerating tube 1 smoothly.

The distance between a plane containing an accelerating tube outlet 9 that is perpendicular to an extension of the center axis of the accelerating tube, and an outermost circumference 15 of an impact surface 16 of an impact member 10 opposed to the accelerating tube outlet 9, $L_2$, should, preferably, range from 0.2 times to 2.5 times, or more preferably, 0.4 times to 1.0 times as long as the diameter of the impact member 10.

When the distance $L_2$ is less than 0.2 times the length of the diameter of the impact member 10, the dust concentration in the vicinity of the impact surface 16 may become abnormally high. When the distance $L_2$ exceeds 2.5 times the length of the diameter, impact force get weak. This may deteriorate the quality of pulverized powder.

The closest distance from the outermost circumference 15 of the impact member 10 to the side wall 14, $L_1$, should, preferably, range from 0.1 times to 2 times as long as the diameter of the impact member 10.

When the $L_1$ is less than 0.1 times the length of the diameter, passage of high-pressure gas causes a great pressure loss. Pulverization efficiency may deteriorate. Pulverized powder tends to flow less smoothly. When the $L_1$ is 2 times or larger the length of the diameter, secondary collision of powder to be pulverized against an inner wall 14 of a pulverizing chamber becomes less effective. Consequently, pulverization efficiency deteriorates.

To be more specific, the preferable length of the accelerating tube ranges from 50 to 500 mm, and the preferable diameter of the impact member 10 ranges from 30 to 300 mm.

Furthermore, the impact surface 16 of the impact member 10 and the side wall 14 should, preferably, be made of ceramic in terms of durability.

Figure 4:
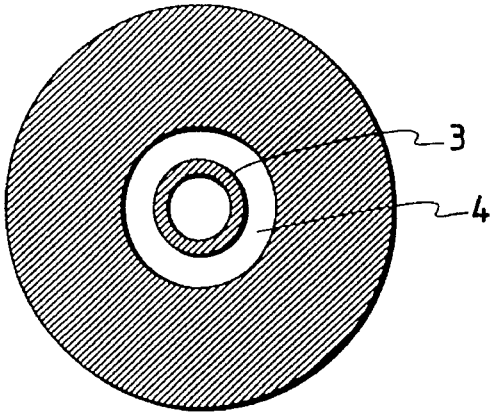
FIG. 4 shows a B—B' cross-section of FIG. 1.

FIG. 4 shows a B—B' cross-section of FIG. 1. In FIG. 4, powder to be pulverized passes through a pulverization powder feed port 4. At this time, the distribution of the powder to be pulverized on a plane perpendicular to the vertical axis of the pulverization powder feed port 4 becomes more partial, as the slope of an accelerating tube 1 with respect to the vertical axis gets larger. The smaller the slope is, the distribution becomes more uniform. The most preferable slope of the accelerating tube ranges from 0° to 5°. This fact has been verified using a transparent acrylic resin accelerating tube for inner observation as the accelerating tube 1.

FIG. 5 shows a C—C' cross section of FIG. 1. In FIG. 5, pulverized powder is evacuated backward through a pulverizing chamber 12 between an impact member support 11 and a side wall 14.

Figure 6:
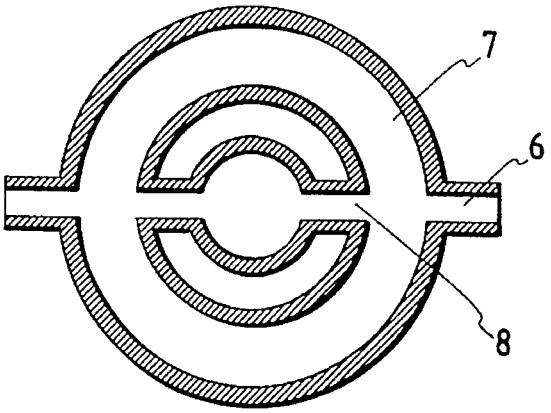
FIG. 6 shows a D—D' cross-section of FIG. 1.

FIG. 6 shows a D—D' cross-section of FIG. 1. In FIG. 6, two high-pressure gas introduction pipes 8 are installed. The number of high-pressure gas introduction pipes may be one, or two, three or more.

Embodiment 2

Figure 7:
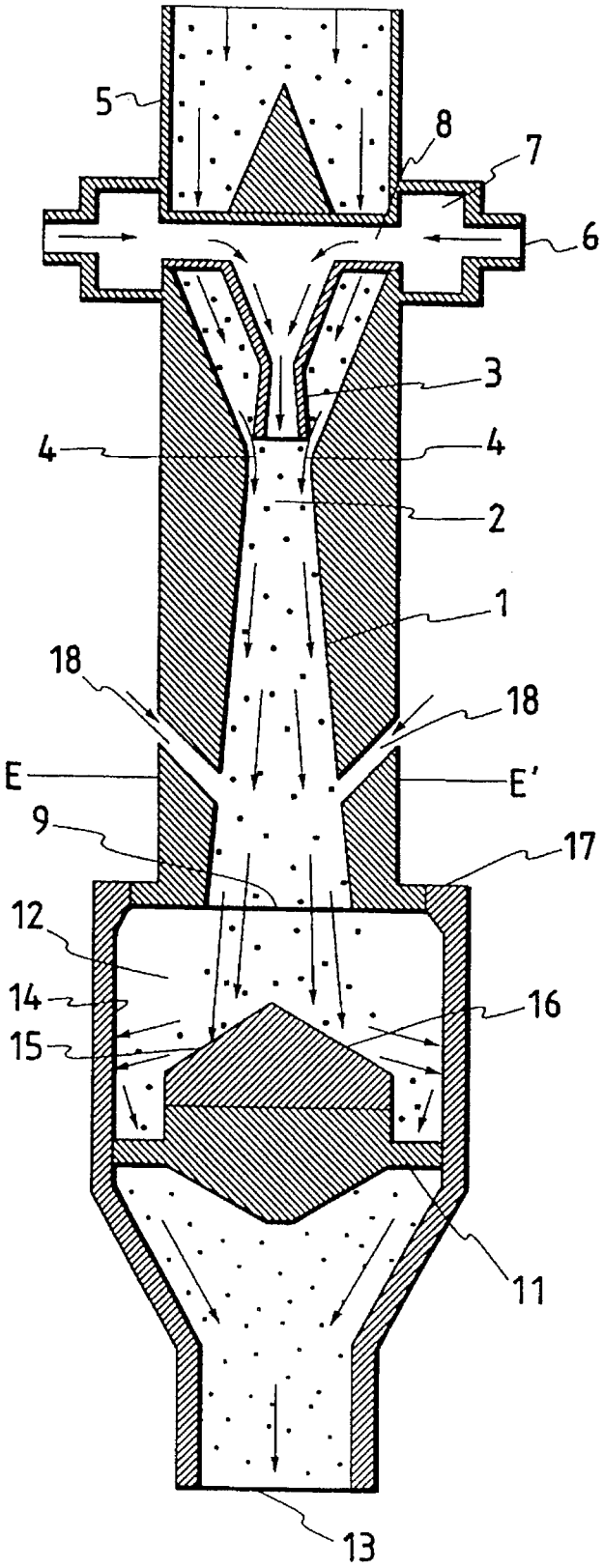
FIG. 7 shows an outline cross-section of other embodiment of a pneumatic impact pulverizer according to the present invention.
Figure 8:
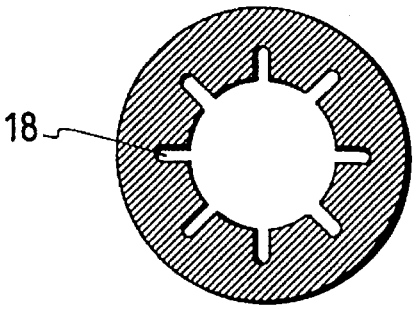
FIG. 8 shows an E—E' cross-section of FIG. 7.

FIGS. 7 and 8 show an embodiment of a pneumatic impact pulverizer having secondary gas intakes 18 between an accelerating tube outlet 9 and a pulverization powder feed port 4.

The secondary gas intakes 18 formed between the accelerating tube outlet 9 and pulverization powder feed port 4 supply gas for preventing occurrence of turbulence due to a whirl occurring in the vicinity of an inner wall of an accelerating tube and thus regulating a stream in the accelerating tube. Herein, the whirl occurs when the high-pressure gas ejected from a high-pressure gas ejection port expands and accelerates rapidly in the accelerating tube.

When powder to be pulverized is accompanied by the high-pressure gas that has rapidly expanded in the accelerating tube and accelerated quickly, the secondary gas fed through the secondary gas intakes regulates a stream. This further improves acceleration performance and upgrades pulverization efficiency.

As for the arrangement of secondary gas intakes, FIG. 8 shows a cross-section in which multiple secondary gas intakes are bored on the inner wall of the accelerating tube to form a concentric plane that is perpendicular to the center axis of the accelerating tube. The arrangement is not limited to this example.

When gas pressure is concerned, gas with atmospheric pressure or gas with pressure applied can be used as gas to be fed through the secondary gas intakes. The pressure or flow rate of gas or air is adjustable according to the purpose or situation of use.

Embodiment 3

Figure 9:
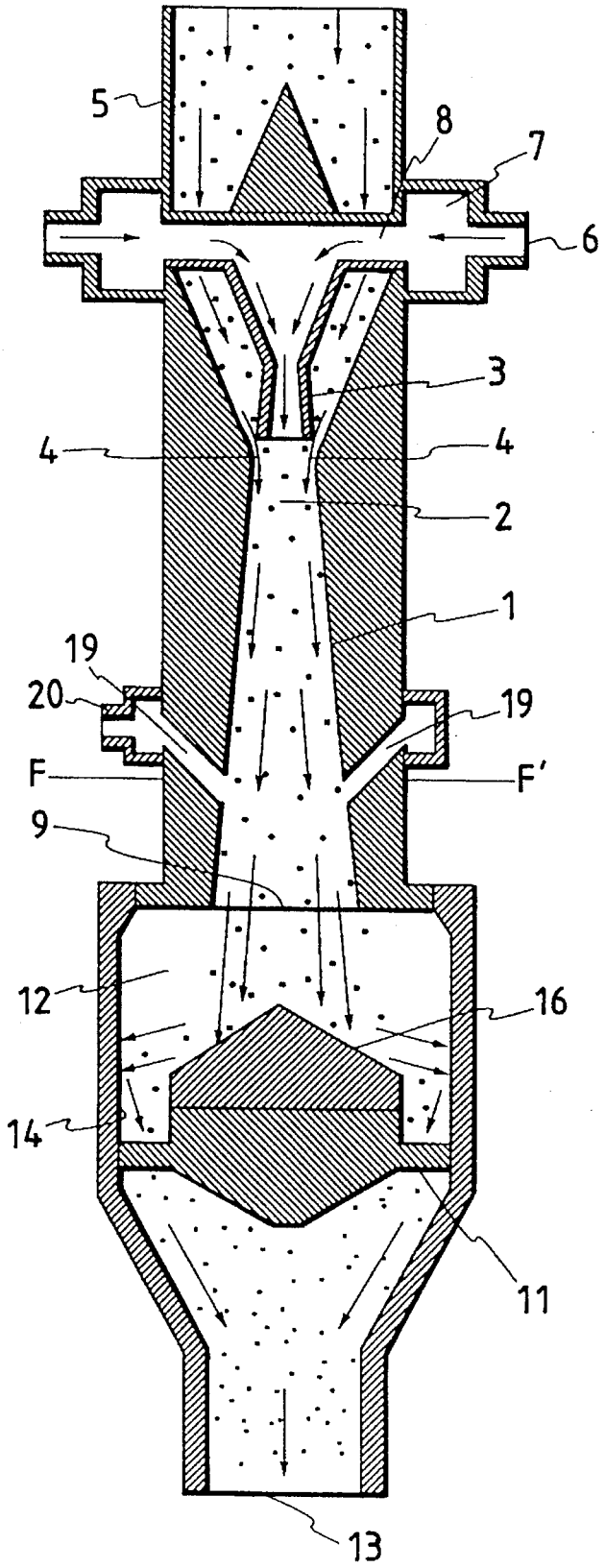
FIG. 9 shows an outline cross-section of another embodiment of a pneumatic impact pulverizer according to the present invention.
Figure 10:
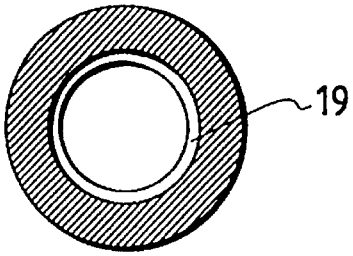
FIG. 10 shows an F—F' cross-section of FIG. 9.

FIGS. 9 and 10 show an embodiment of a pneumatic impact pulverizer having a ring-type secondary gas intake 19 between an accelerating tube outlet 9 and a pulverization toner feed port 4. Air with normal pressure or air or gas with pressure applied is fed to the secondary gas intake 19 via a gas introduction member 20.

FIG. 10 shows an F—F' cross-section of FIG. 9.

Embodiment 4

Figure 11:
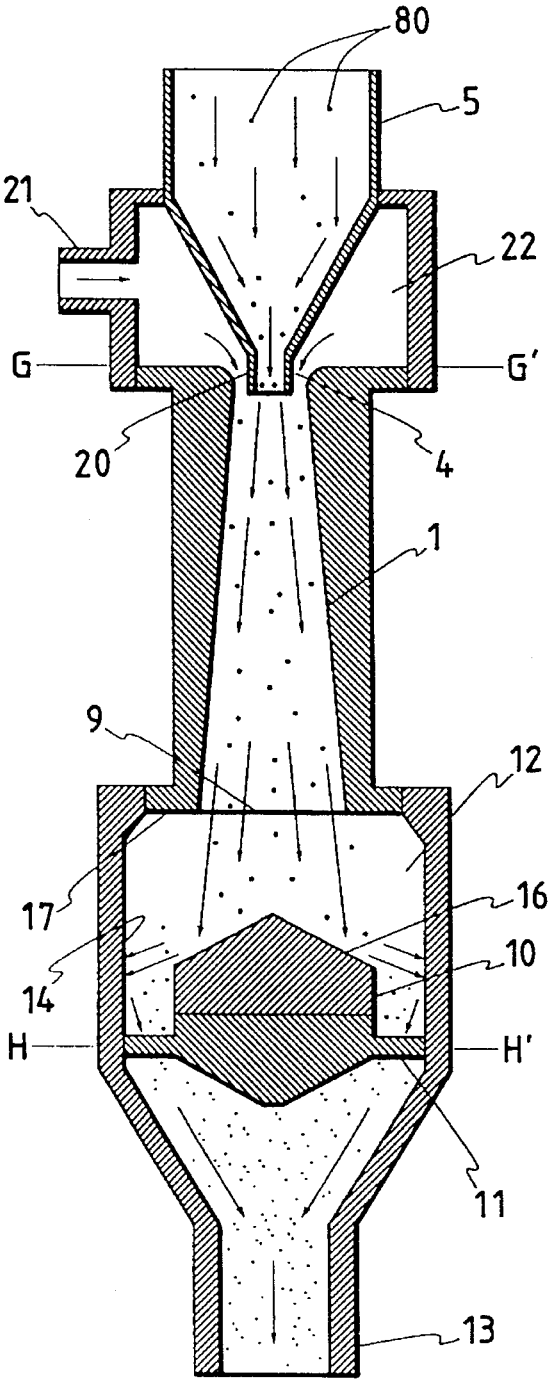
FIG. 11 shows an outline cross- section of another embodiment of a pneumatic impact pulverizer according to the present invention.
Figure 12:
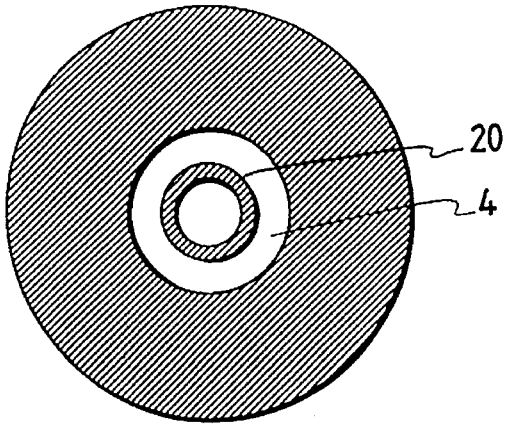
FIG. 12 shows a G—G' cross-section of FIG. 11.
Figure 13:
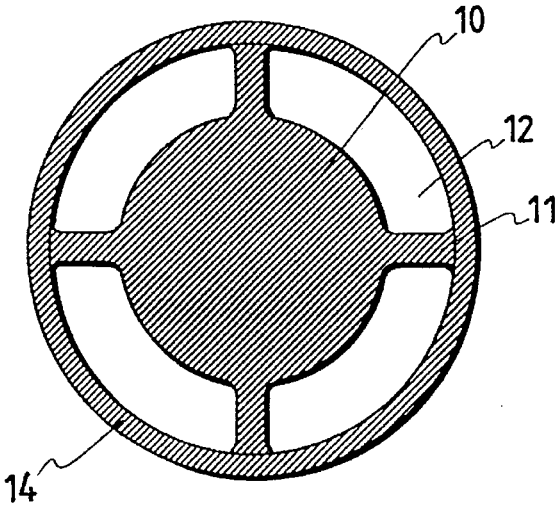
FIG. 13 shows an H—H' cross-section of FIG. 11.

FIGS. 11 to 13 are schematic diagrams showing another embodiment of a pneumatic impact pulverizer according to the present invention.

In FIG. 11, numerals identical to those in FIG. 1 denote the same members.

In a pneumatic impact pulverizer shown in FIG. 11, the longitudinal slope of an accelerating tube 1 should, preferably, range from 0° to 45° (more preferably, 0° to 20°, or further more preferably, 0° to 5°) with respect to the vertical line. Powder to be pulverized 80 passes through an accelerating tube throat 4 via a pulverization powder feed port 20, and enters the accelerating tube 1. Compressed gas or compressed air is routed to the accelerating tube 1 through an opening formed between the inner wall of the throat 4 and the outer wall of the pulverization powder feed port. The powder to be pulverized 80 that has been fed to the accelerating tube 1 is accelerated instantaneously to have a high speed, then ejected from an accelerating tube outlet 9 to a pulverizing chamber 12 at a high speed. Then, the powder to be pulverized 80 collides with an impact surface 16 of an impact member 10 to pulverize.

Thus, powder to be pulverized 80 is supplied from the center of a throat 4 of an accelerating tube 1, dispersed in an accelerating tube 1, and ejected uniformly from an accelerating tube outlet 9. This allows the ejected powder to efficiently collide with an impact surface 16 of an impact member 10 opposed to the outlet 9. This results in higher pulverization efficiently.

When an impact surface 16 of an impact member 10 has a conical shape as shown in FIG. 11 or a conical projection as shown in FIG. 22, post-collision dispersion improves. Therefore, powder to be pulverized neither fuses, coagulates, nor gets coarser. This enables pulverization at a high dust concentration. When abrasive toner is to be pulverized, abrasion occurring on an inner wall of an accelerating tube or an impact surface of an impact member does not concentrate regionally. This realizes extended service life and enables stable operation.

FIG. 12 shows a G—G' cross-section of FIG. 11. Powder to be pulverized 80 is fed to an accelerating tube 1 via a pulverization powder feed nozzle 20. High-pressure gas is fed to the accelerating tube 1 via a throat 4.

FIG. 13 shows an H—H' cross-section of FIG. 11. Similarly to a pulverizer shown in FIG. 1, if the longitudinal slope of an accelerating tube 1 ranges from 0° to 45°, powder to be pulverized 80 will not block a pulverization powder feed port 20 but go down to be processed. If powder to be pulverized 80 has poor fluidity, the powder tends to stagnate on the bottom of a pulverization powder feed pipe 5. When the slope of the accelerating tube 1 ranges from 0° to 20° (more preferably, 0° to 5°), the powder to be pulverized 80 will not stagnate but enter the accelerating tube 1 smoothly.

Comparing a pulverizer shown in FIG. 1 with another one shown in FIG. 11, the pulverizer of FIG. 1 offers higher pulverization efficiency. This is because powder to be pulverized 80 is excellently dispersed and fed to an accelerating tube.

Embodiment 5

Figure 14:
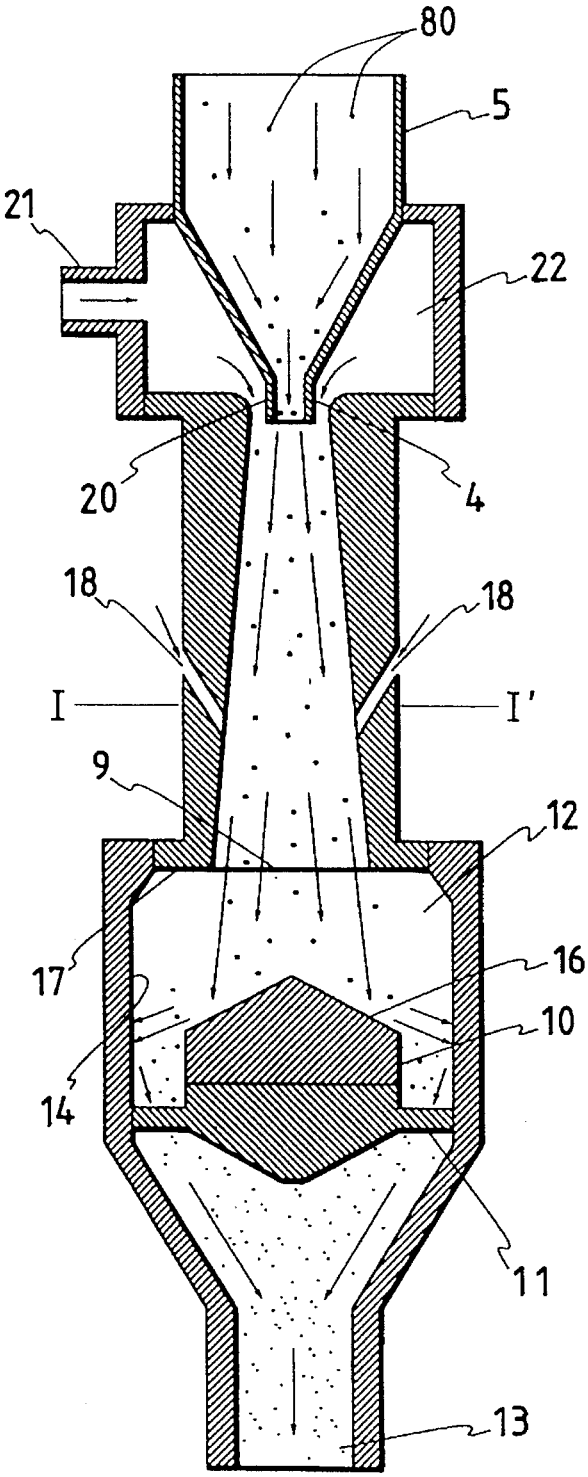
FIG. 14 shows an outline cross-section of another embodiment of a pneumatic impact pulverizer according to the present invention.
Figure 15:
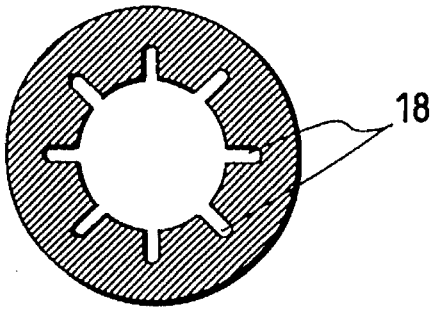
FIG. 15 shows an I—I' cross-section of FIG. 14.

FIGS. 14 and 15 show an embodiment of a pneumatic impact pulverizer having secondary gas intakes 18 between an accelerating tube outlet 9 and a throat 4.

FIG. 15 shows a I—I' cross-section of FIG. 14.

Embodiment 6

Figure 16:
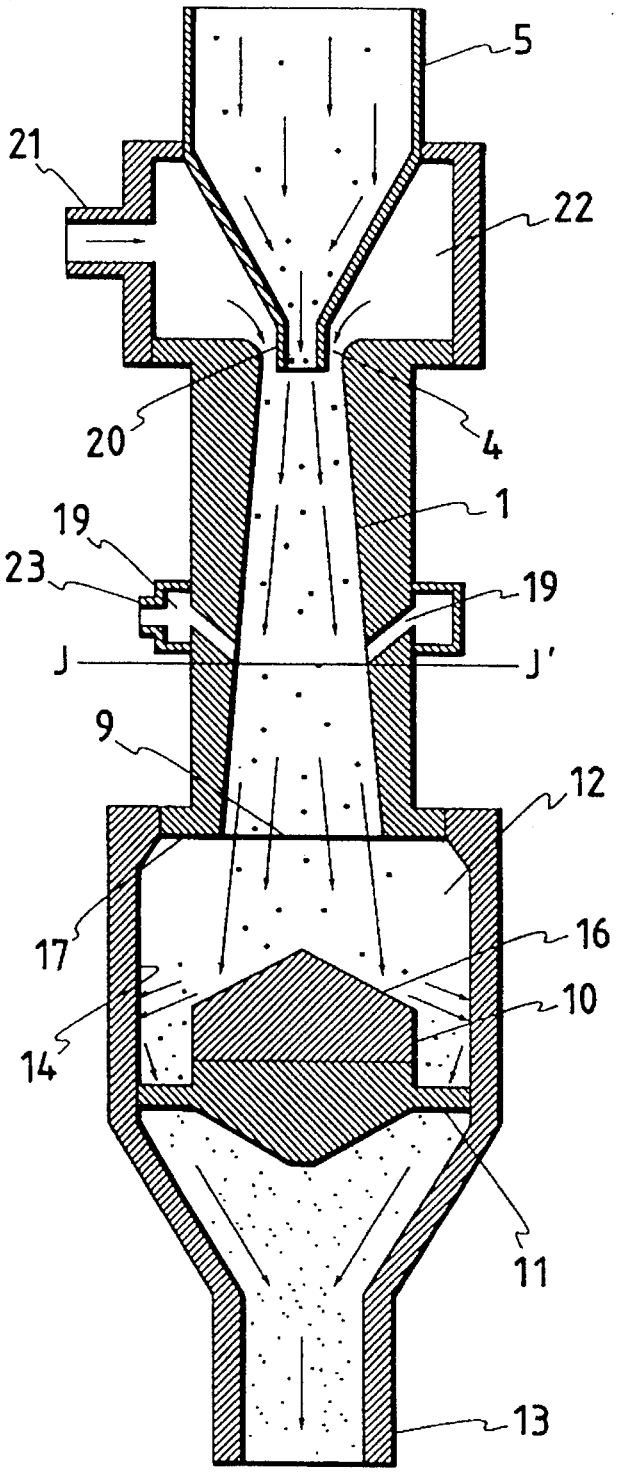
FIG. 16 shows an outline cross-section of another embodiment of a pneumatic impact pulverizer according to the present invention.
Figure 17:
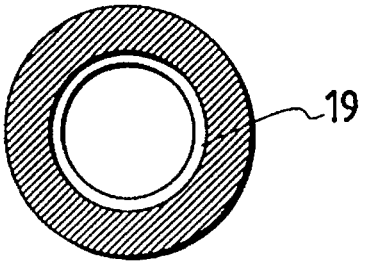
FIG. 17 shows a J—J' cross-section of FIG. 16.

FIGS. 16 and 17 show an embodiment of a pneumatic impact pulverizer having a ring-type secondary gas intake 19 between an accelerating tube outlet 9 and a throat 4. Air with normal pressure or gas or air with pressure applied is fed from a gas introduction means 20 to the secondary gas intake 19.

FIG. 17 shows a J—J' cross-section of FIG. 16.

Embodiment 7

Figure 18:
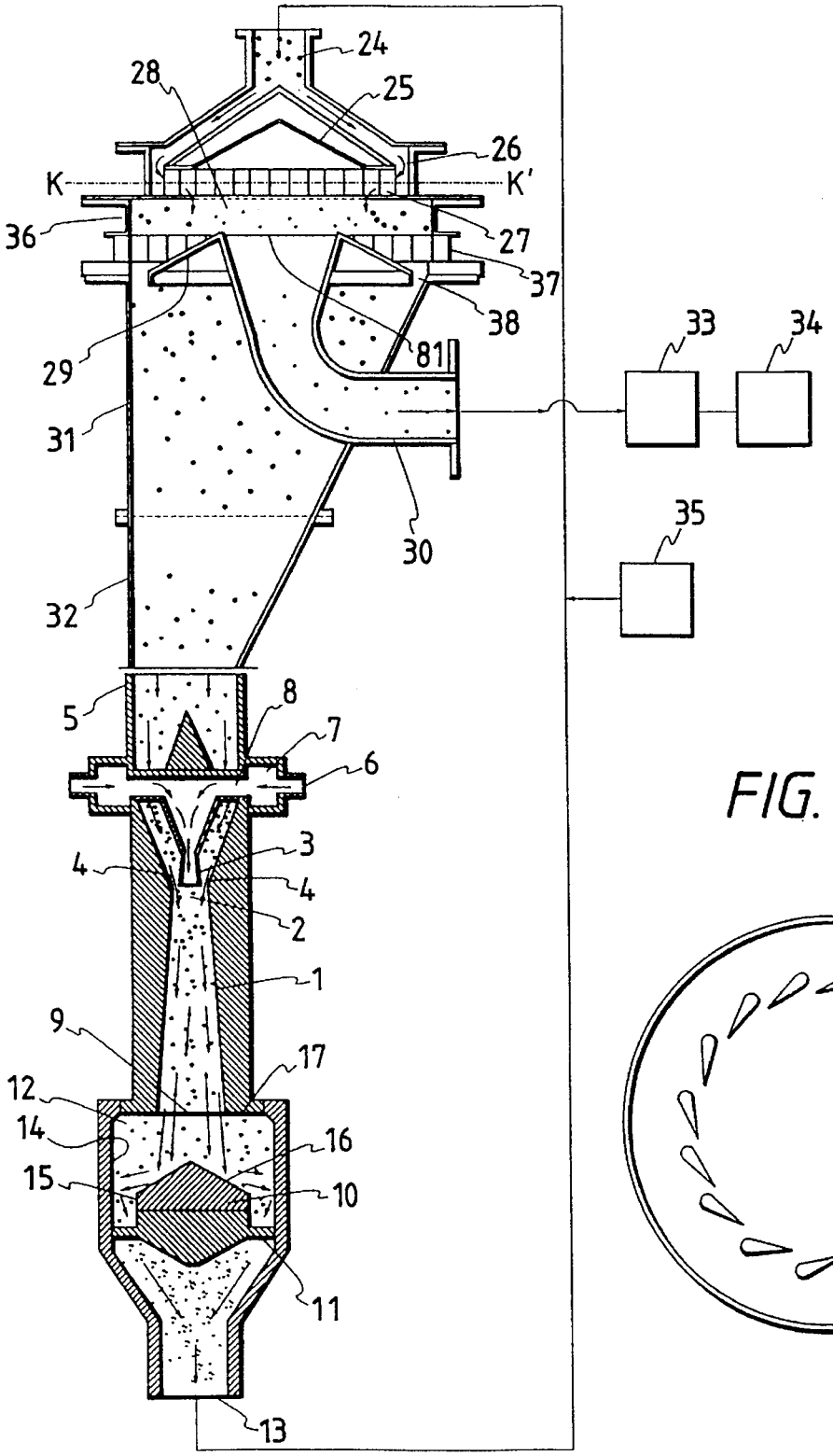
FIG. 18 shows an embodiment of a fine powder production system according to the present invention.

FIG. 18 is a schematic drawing showing an embodiment of a fine powder production system according to the present invention.

In FIG. 18, a pulverization powder feed pipe in a pneumatic impact pulverizer communicates with a hopper having a coarse powder discharge opening in a pneumatic classifier, and a pulverized powder discharge port 13 of the pneumatic impact pulverizer communicates with a powder feed pipe 24 of the pneumatic classifier.

A pneumatic impact pulverizer employed in this embodiment is of the same type as the one shown in FIG. 1.

In FIG. 18, 36 denotes a cylindrical body casing. 31 denotes a lower casing, which is connected to a hopper 32 for discharging coarse powder. A classifying chamber 28 is formed in the body casing 36. The top of the classifying chamber 28 is sealed with a ring-type guide chamber 26 and a conical (bevel) upper cover 25 having its center swelled. The guide chamber 26 and upper cover 25 form the upper part of the body casing 36.

Multiple introduction louvers are arranged in the circumferential direction on a partition between the classifying chamber 28 and guide chamber 26. Powder material and air fed into the guide chamber 26 pass through the apertures of the introduction louvers 27 to whirl and flow in the classifying chamber 28. For precise classification, it is preferred that the air and powder material entering the guide chamber 45 through a feed pipe 24 be distributed uniformly to the introduction louvers 27. The passage of the powder material to the introduction louvers 27 must be shaped so that concentration will hardly occur due to centrifugal force. In this embodiment, the feed pipe 24 is connected from above and perpendicularly to the horizontal plane of the classifying chamber 28. The way of connecting the feed pipe 24 is not limited to the above.

Thus, air and powder material are fed to the classifying chamber 28 via the introduction louvers 27. The passage leading to the classifying chamber 28 permits markedly higher dispersion efficiency than a conventional one does. The introduction louvers 27 are movable, and the apertures of the introduction louvers 27 are adjustable.

In the lower part of the body casing 36, a classifying louver 37 is arranged in the circumferential direction so that classification air for externally inducing a whirling stream in the classifying chamber 28 will be taken in through the classifying louver 37.

On the bottom of the classifying chamber 28, a conical (bevel) classifying plate 29 having its center swelled is installed. A coarse powder discharge opening 38 is formed along the outer circumference of the classifying plate 29. A fine powder discharge chute 30 having a fine powder discharge port 81 is connected to the center of the classifying plate 29. The lower end of the fine powder discharge chute 30 is bent in the shape of an L. The bending end is located outside the side wall of the lower casing 31. The fine powder discharge chute 30 is connected to a suction fan 34 via a cyclone, a dust collector, or other fine powder collecting means 33. The suction fan 34 operates to induce suction force in the classifying chamber 28. Suction air entering the classifying chamber 28 via the apertures of the classifying louver 37 develops a whirling stream necessary for classification.

A pneumatic classifier in this embodiment has the foregoing configuration. A feed pipe 24 feeds powder material to a guide chamber 26 together with air. The air containing the powder material passes through the apertures of louvers 27 via a guide chamber 26, whirls and disperses to have a uniform concentration, and flows in a classifying chamber 28.

The whirling powder material that enters the classifying chamber 28 whirls more vigorously with a suction air stream that originates from a suction fan 34 connected to a fine powder discharge chute 30 and flows in through the apertures of a classifying louver 37 in the lower part of the classifying chamber. With centrifugal force applied to the particles, the powder material is separated into coarse powder and fine powder. Then, coarse powder whirling on the circumferential surface of the classifying chamber 28 is discharged through the coarse powder discharge opening 38, evacuated through a hopper 32 in the lower part of the pneumatic classifier, then fed to a pulverization powder feed pipe 5. Fine powder moves on the upper inclined plane of the classifying plate 29 to reach the central area. Then, the fine powder is discharged to the fine powder collecting means 33 through the fine powder discharge chute 30.

Air entering the classifying chamber 28 together with powder material forms a whirling stream. Therefore, the center-oriented velocities of particles whirling in the classifying chamber 28 are relatively low as compared with centrifugal force. Particles having small diameters are successfully classified in the classifying chamber 28. Fine powder having very small diameters can be evacuated efficiently to the fine powder discharge chute 30. Furthermore, powder material enters the classifying chamber with almost a uniform concentration. Thus, finely-distributed powder results.

Pulverization material is routed to the feed pipe 24 by an appropriate introduction means 35. Finally, pulverized powder is evacuated outside by the fine powder discharge chute 30 through a cyclone, a bag filter, or other fine powder collector.

Figure 19:
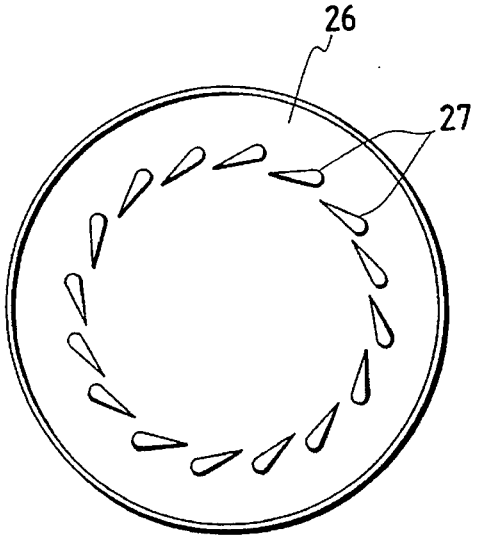
FIG. 19 shows a K—K' cross-section of FIG. 18.

FIG. 19 shows a K—K' cross-section of FIG. 18.

When a pneumatic classifier and a pneumatic impact pulverizer are used in combination as shown in FIG. 18, invasion of fine powder into a pulverizer is suppressed or hindered successfully. This prevents excess pulverization of pulverized powder. Classified coarse powder is fed to the pulverizer smoothly or dispersed in an accelerating tube uniformly. Therefore, the coarse powder is pulverized efficiently in a pulverizing chamber. This results in a high yield of pulverized powder and a high energy efficiency per unit weight.

Embodiment 8

Figure 20:
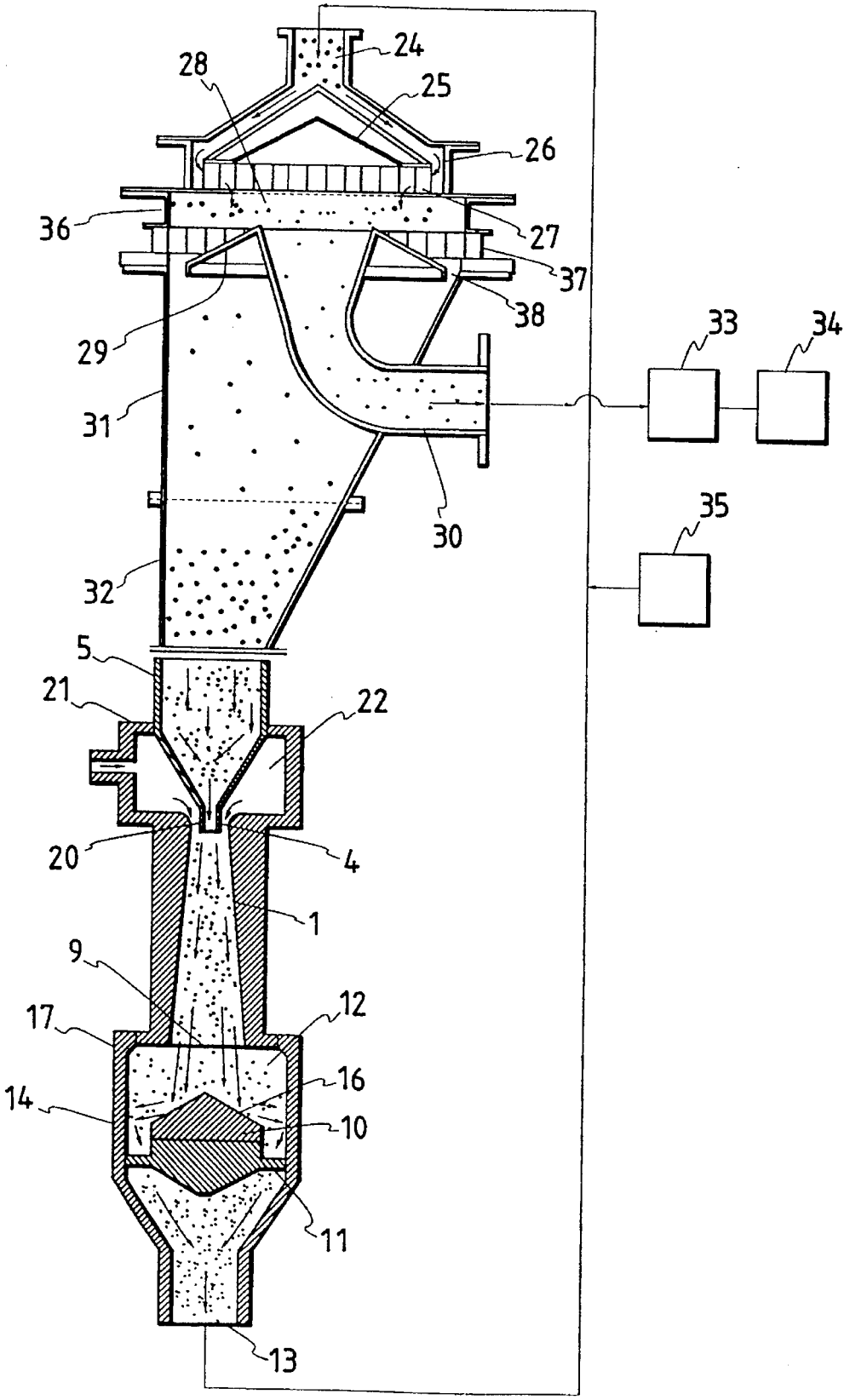
FIG. 20 shows another embodiment of a fine powder production system according to the present invention.

FIG. 20 is a schematic drawing showing another embodiment of a fine powder production apparatus according to the present invention.

The pulverizer shown in FIG. 11 is employed as a pneumatic impact pulverizer.

A fine powder production apparatus of the present invention is suitable for producing toner particles for use in developing electrostatic images.

Toner for developing electrostatic images (for example, toner of weight-average particle sizes ranging from 3 to 20 μm) is produced as follows: a colorant or magnetic powder, a vinyl or non-vinyl thermoplastic resin, a charge control agent, if necessary, and other additives are mixed using a Henschel mixer, a ball mill, or other mixer, then melted and kneaded using a heating roll, a kneader, an extruder, or other thermal kneader so that resins will be fused with one another. Then, a pigment or dye is dispersed or dissolved in the mixture. After that, the mixture is cooled and caked, then pulverized and classified. Thus, toner is produced. A fine powder production system of the present invention is employed in the processes of pulverization and classification.

Next, materials comprising the toner will be described.

When a heating pressure fixing unit or a heating pressure roller fixing unit is used, toner binder resins listed below are usable.

Homopolymer of styrene or substitution products thereof such as polystyrene, poly-p-chlorostyrene, and polyvinyl toluene; styrene-p-chlorostyrene copolymer, styrene-vinyl toluene copolymer, styrene-vinyl naphthalene copolymer, styrene-acrylic ester copolymer, styrene-ester methacrylate copolymer, styrene-chloromethyl methacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrileindene copolymer, and other styrene copolymers; polyvinyl chloride, phenol resin, natural denaturated phenol aldehyde resin, natural resin denaturated maleic resin, acrylic resin, methacrylic resin, polyvinyl acetate, silicone resin, polyester resin, polyurethane resin, polyamide resin, fran resin, epoxy resin, xylene resin, polyvinyl butyral, terpene resin, coumarone-indene resin, and petroleum resins.

In a heating pressure fixing method of a pressure heating roller fixing method in which oil is hardly or never applied, an offset phenomenon or a phenomenon that part of a toner image on a-toner image support member is transferred to a roller, or adhesion of toner to the toner image support member must be treated attentively. Toner that fixes with a smaller amount of thermal energy is likely to cause blocking or caking during storage or in a developing unit. These problems must also be solved. The above phenomena are caused mainly from the properties of a binder resin contained in toner. The studies of the present inventors have demonstrated that when the content of a magnetic material in toner decreases, adhesion of toner to the toner support during fixing improves but occurrence of offset increases. Furthermore, blocking and caking occurs more frequently. Therefore, when a heating pressure roller fixing method in which oil is hardly applied is adopted, choice of a binder resin becomes very important. Preferable binder materials are a cross-linked styrene copolymer or cross-linked polyester.

Comohomers for styrene copolymers include acrylic acid, acrylic methyl, acrylic ethyl, acrylic butyl, acrylic dodecyl, acrylic octyl, acrylic-2-ethyl hexyl, acrylic phenyl, methacrylic acid, methyl methacrylate, ethyl methacrylate, butyl methacrylate, octyl methacrylate, acrylonitrile, methacrylonitrile, acrylamid, and other monocarboxylic acids containing double bonds, and their substitution products; for example, maleic acid, maleic butyl, maleic methyl, maleic dimethyl, and other dicarboxylic-acids containing double bonds, and their substitution products; for example, vinyl chloride, vinyl acetate, vinyl benzoate, and other vinyl esters; for example, ethylene, propylene, butylene, and other ethylene olefins; for example, vinyl methyl ketone, vinyl hexylketone, and other vinyl ketones; for example, vinyl methyl ether, vinyl ethyl ether, vinyl isobutyl ether, and other vinyl ethers. The above vinyl monomers are used independently or in combination of two or more monomers.

A cross linking agent may be a compound containing two or more double bonds in which monomers can be polymerized; such as, divinylbenzene, divinylnaphthalene, or other aromatic divinyl compound; such as, ethylene glycol diacrylate, ethylene glycol dimethacrylate, 1,3 butanediol dimethacrylate, or other carboxylic ester containing two double bonds; divinyl aniline, divinyl ether, divinyl sulfide, divinyl sulfane, or other divinyl compounds; or other compounds containing three or more vinyl radicals. The above compounds may be used alone or in combination.

When a pressure fixing method or a light heating pressure fixing method is adopted, binder resins for use in a toner fixing with pressure may be employed. The binder resins include polyethylene, polypropylene, polymethylene, polyurethane elastomer, ethylene-ethylacrylate copolymer, ethylene-vinyl acetate copolymer, ionomer resin, styrene-butadiene copolymer, styrene-isoprene copolymer, linear saturation polyester, and paraffin.

It is preferred that a charge control agent be added to or mixed in toner particles. The charge control agent optimizes control of the number of charges according to a developing system. In the present invention, the charge control agent assists in further stabilizing the balance between the distribution of particle sizes and the number of charges. The employment of the charge control agent intensifies functional separation for optimizing image quality in groups of particle sizes and enhances complementary relationships among the particle size groups. Positive charge control agents include modified products of nigrosine and fatty acid metallic salt; such as, tributyl benzyl ammonium-1-hydroxy-4-naphthosulfonium salt, tetrabutyl ammonium tetrafluoroborate, and other quaternary ammonium salts. These substances can be used independently or in combination of two or more substances. Among them, nigrosine compounds and quaternary ammonium salts are preferable.

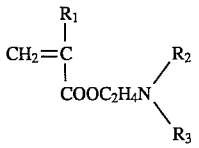

where, $R_1$ represents H or $CH_3$, and $R_2$ and $R_3$ represent a substituted or non-substituted alkyl group (preferably, $C_1$ to $C_4$). Homopolymers composed of monomers each of which is provided as the above formula, or a copolymer copolymerized with styrene, acrylic ester, methyl methacrylate, or other polymerizable monomer can be employed as a positive charge control agent. Such charge control agents also serve (fully or partly) as binder resins.

Effective negative charge control agents are, for example, organometal complexes and chelate compounds; such as, aluminum acetylacetonate, iron (II) acetylacetonate, and chrome or zinc 3 and 5-ditertiary butyl salicylate. Above all, metal acetyl-acetonate complexes and metal salicylate complexes or salts are preferable. In particular, metal salicylate complexes or salts are preferred.

The above charge control agents (that do not act as binder resins) should, preferably, be used in the form of fine particles. In this case, the number-average particle size of a charge control agent should, preferably, be 4 μm or less (more preferably, 3 μm).

When mixed in toner, such charge control agent should, preferably, range from 0.1 to 20 parts by weight based on 100 parts by weight of a binder resin.

When magnetic toner is employed, a magnetic material to be contained in the magnetic toner includes; magnetite, gamma-iron oxide, ferrite, excess-iron ferrite, and other iron oxides; metal such as iron, cobalt, and nickel; their alloys with metal such as aluminum, cobalt, copper, lead, magnesium, tin, zinc, antimony, beryllium, bismuth, cadmium, calcium, manganese, selenium, titanium, tungsten, vanadium; and their mixtures.

Those magnetic materials may have an average particle size ranging from 0.1 to 1 μm, or preferably, 0.1 to 0.5 μm. The content of a magnetic material in toner should range from 60 to 110 parts by weight based on 100 parts by weight of a resin component, or preferably, 65 to 100 parts by weight based on 100 parts by weight of a resin component.

A colorant employed for toner may be a widely-adopted dye and/or pigment. For example, carbon black, copper phthalocyanine, peacock blue, permanent red, lake red, rhodamine lake, Hansa yellow, permanent yellow, and bendizine yellow can be used. The content ranges from 0.1 to 20 parts by weight, or preferably, 0.5 to 20 parts by weight based on 100 parts of a binder resin. To improve transparency of OHP film on which toner images are fixed, 12 parts by weight is preferred. More preferably, the contents should range 0.5 to 9 parts by weight.

Next, an embodiment of a process of producing toner will be described.

Embodiment 9

Styrene-butylacrylate-divinyl benzene copolymer: 100 parts by weight (monomer polymerization ratio by weight: 80.0/19.0/1.0, weight-average molecular weight: Mw 350,000)

Magnetic iron oxide (average particle size: 0.18 μm): 100 parts by weight

Nigrosine: 2 parts by weight

Low molecular weight ethylene-propylene copolymer: 4 parts by weight

The above materials are prepared and mixed using a Henschel mixer (FM-75 manufactured by Mitsui Miike Chemical Industries, Co., Ltd.), then kneaded using a biaxial kneader (PCM-30-manufactured by Ikegai Iron Works, Co., Ltd.). Then, the kneaded mixture is cooled, then coarsely pulverized to have a diameter of 1 mm or less using a hammer mill. This results in coarsely-pulverized powder for producing toner.

The resulting coarsely-pulverized powder for toner is classified and pulverized using a fine powder production apparatus (hereafter, fine power production system A) made up of a pneumatic classifier and a pneumatic impact pulverizer shown in FIG. 18. In the pneumatic impact pulverizer, an accelerating tube is inclined in the longitudinal direction by about 0° (substantially, resting vertically) with respect to the vertical line. An employed impact member has an impact surface that is shaped like a cone having an apex angle of 160° and an outer diameter of 100 mm. The closest distance from the plane of an accelerating tube outlet that is perpendicular to the center axis of the accelerating tube to the outermost circumference of the impact surface of the impact member opposed to the accelerating tube outlet, $L_2$, is 50 mm. A pulverizing chamber has a cylindrical shape of 150 mm in inner diameter. Therefore, the closest distance $L_1$ is 25 mm. A table-type quantitative feeder is used to measure out coarse powder at a rate of 35.4 kg/H. Then, an injector feeder is used to feed the powder to the pneumatic classifier via a raw material feeder and a feed pipe. The classified coarse powder is routed to a coarse powder discharge hopper, then evacuated to a pneumatic impact pulverizer through a pulverization powder feed pipe. Then, the classified coarse powder is pulverized using compressed air that is compressed with pressure of 6.0 kg/cm$^2$(G) or 6.0 Nm$^3$/min. Then, the pulverized powder is mixed with coarse powder fed from the raw material feeder, fed back to the pneumatic classifier, then pulverized in a looped state. The classified fine powder is scavenged while accompanied by suction air originating from a discharge fan. This resulted in a finely pulverized-and-classified product showing sharp distribution of particle sizes of 8.4 μm in weight-average diameter.

The finely pulverized-and-classified product is classified using a dispersion separator DS5UR (Japan Pneumatic Industries, Co., Ltd.). This classification eliminates very fine particles that are smaller than a specified particle size. A product thus classified to permit high yield turned out to be excellent toner.

Various methods are conceivable to measure the distribution of particle sizes of a finely pulverized-and-classified product or toner. In this embodiment, a Coulter counter was used.

A Coulter counter TA-11 (Coulter Inc.) was used as a measuring instrument. An interface (Japan Scientific Machinery Manufacturing Co., Ltd.) for outputting a number distribution or a volume distribution and a personal computer CX-1 (Canon Inc.) were connected. 1-% NaCl solution was prepared as electrolyte by using first class sodium chloride. A measuring procedure will be described. First, 0.1 to 5 ml of a surface-active agent as a dispersant, preferably, alkylbenzene sulfonium salt was added to 100 to 150 ml of the above electrolyte solution. Then, 2 to 20 mg of a test sample was added. The electrolyte with the sample suspended was dispersed for about one to three minutes using an ultrasonic dispersing device. Using the Colter counter TA-11 whose aperture was set to 100μ, the numbers of reference particles of 2 to 40μ in diameter were counted to produce a distribution of particle sizes. Based on the measured values, a weight-average particle diameter and a volume-average particle diameter were calculated.

Embodiment 10

Coarsely-pulverized toner powder identical to that used in Embodiment 9 was employed. In the fine powder production system A of the same type as that used in Embodiment 9, the slope of an accelerating tube was set to 15°, and a coarse powder feed rate, to 33.6 kg/H. This pulverization provided a finely pulverized-and-classified product showing sharp distribution of particle sizes of 8.6 μm in weight-average diameter.

Embodiment 11

Coarsely-pulverized toner power identical to that used in Embodiment 9 was employed. In the fine powder production system A of the same type as that used in Embodiment 9, a distance from an impact surface was set to 100 mm, and a coarse powder feed rate, to 32.6 kg/H. This pulverization provided a finely pulverized-and-classified product showing sharp distribution of particle sizes of 8.5 μm in weight-average diameter.

Embodiment 12

Coarsely-pulverized toner powder and the fine powder production system A identical to those used in Embodiment 9 were employed. A distance from an impact surface was set to 30 mm, and a coarse toner powder feed rate, to 30.3 kg/H. This pulverization provided a finely pulverized-and-classified product showing sharp distribution of particle sizes of 8.4 μm in weight-average diameter.

Embodiment 13

Coarsely-pulverized toner powder and the fine powder production system A indentical to those used in Embodiment 9 were employed. A distance from an impact surface was set to 22 mm, and a coarse toner powder feed rate, to 22.5 kg/H. This pulverization provided a finely pulverized-and-classified product having a weight-average diameter of 8.4 μm.

Embodiment 14

Coarsely-pulverized toner powder and the fine powder production system A indentical to those used in Embodiment 9 were employed. A cylindrical pulverizing chamber had an inner diameter of 120 mm. A coarse powder feed rate was set to 22.5 kg/H. This pulverization provided a finely pulverized-and-classified product having a weight-average diameter of 8.4 μm.

Embodiment 14

Coarsely-pulverized toner powder and the fine powder production system A identical to those used in Embodiment 9 were employed. A cylindrical pulverizing chamber had an inner diameter of 120 mm. A coarse powder feed rate was set to 32.6 kg/H. This pulverization provided a finely pulverized-and-classified product having a weight-average diameter of 8.6 μm.

Embodiment 15

Coarsely-pulverized toner powder and the fine powder production system A identical to those used in Embodiment 9 were employed. A cylindrical pulverizing chamber had an inner diameter of 220 mm. A coarse powder feed rate is set to 28.6 kg/H. This pulverization provided a finely pulverized-and-classified product having a weight-average diameter of 8.5 μm.

Embodiment 16

Coarsely-pulverized toner powder and the fine powder production system A identical to those used in Embodiment 9 were employed. An impact surface had an outer diameter of 100 mm and a conical projection with an apex angle 55° as shown in FIGS. 21 and 22. A distance from the impact surface $L_2$, was set to 50 mm, and a coarse powder feed rate, to 35.4 kg/H. This pulverization provided a finely pulverized-and-classified product showing sharp distribution of particle sizes of 8.4 μm in weight-average diameter.

Embodiment 17

Coarsely-pulverized toner powder identical to that used in Embodiment 9 was employed. A fine powder production apparatus made up of a pneumatic classifier and a pneumatic impact pulverizer shown in FIG. 20 (hereafter, fine powder production system B) was used to perform classification and pulverization. The slope of an accelerating tube was 0°. An impact member had an impact surface having a conical shape with an apex angle of 160° and a cylindrical shape of 100 mm in outer diameter. A distance from the impact surface, $L_2$, was set to 50 mm. A pulverizing chamber had a cylindrical shape of 150 mm in inner diameter. The closest distance, $L_1$, was 25 mm.

A table-type quantitative feeder was used to measure coarsely-pulverized toner powder at a rate of 26.5 kg/H. An injection feeder was used to feed the coarsely-pulverized toner powder with compressed air that was compressed with pressure of 6.0 kg/cm$^2$ (G) or 6.0 Nm$^3$/min. Then, pulverization was carried out in a looped state. This resulted in a finely pulverized and classified product having a weight-average diameter of 8.6 μm.

Comparative example 1

Figure 24:
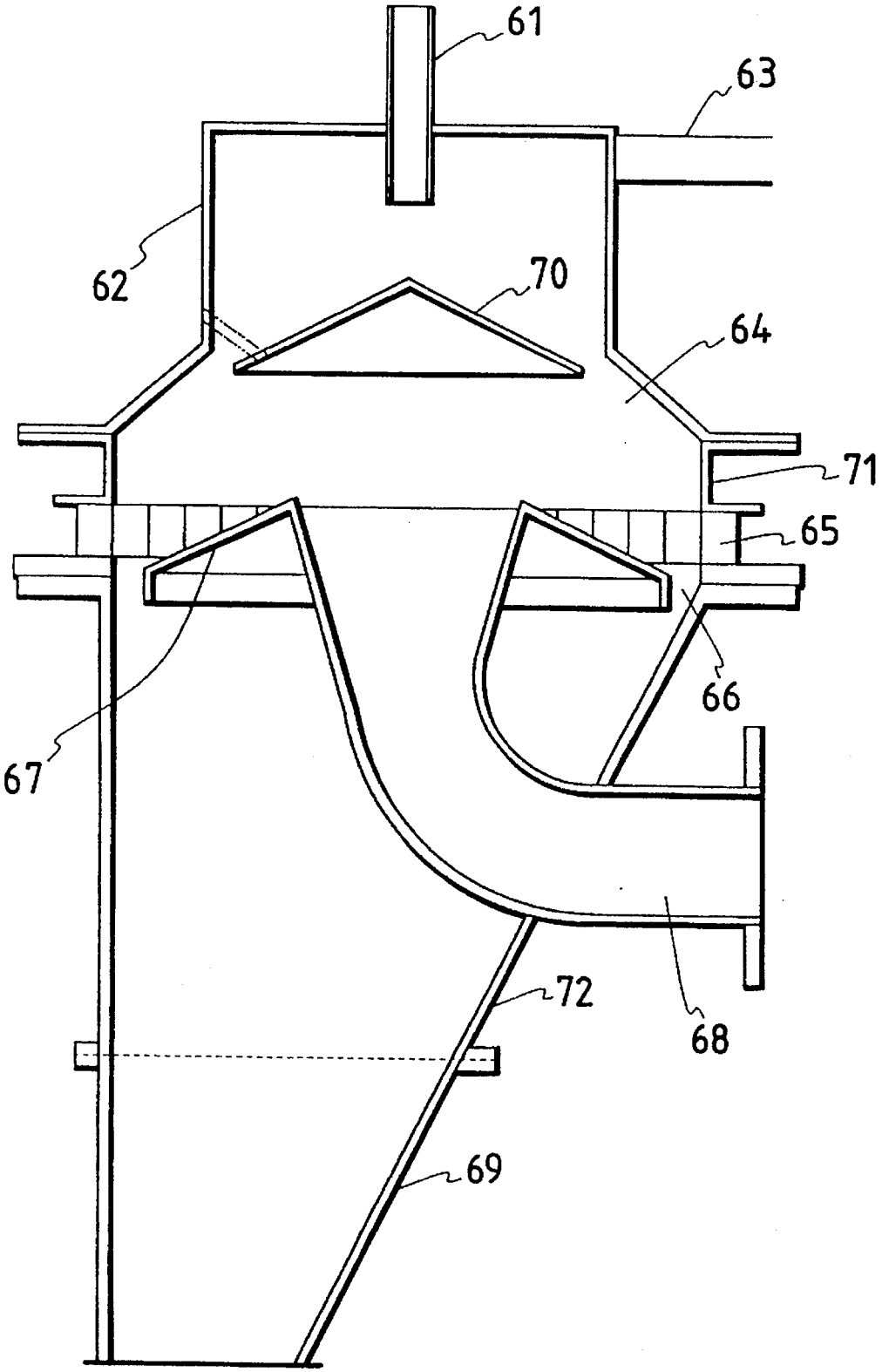
FIG. 24 shows an outline cross-section of a conventional general pneumatic pulverizer.
Figure 25:
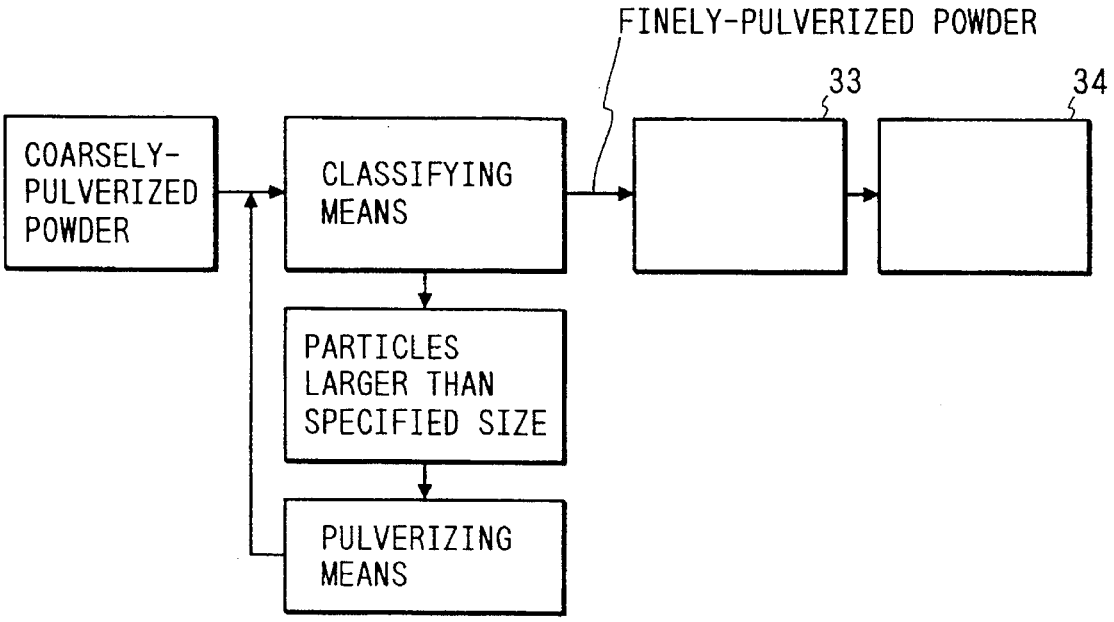
FIG. 25 is a flow chart showing the operations of a classifying and pulverizing system used in a comparative example.

A pulverizer shown in FIG. 23 was used as a pneumatic impact pulverizer. A classifier shown in FIG. 24 was used as a pneumatic classifier. In a classifying and pulverizing system (hereafter, fine powder production system C) that operates according to the flow chart of FIG. 25, coarsely-pulverized powder identical to that prepared in Embodiment 9 was employed, and high-pressure gas was fed to the pneumatic impact pulverizer by injecting compressed air at a rate of 6.0 kg/cm$^2$ (G) or 6.0 Nm$^3$/min. Then, classification and pulverization were carried out at a throughput of 16.4 kg/H.

The weight-average diameter of particles in a finely pulverized-and-classified product was 8.4 μm. Content of very fine and coarse powder was high, and the distribution of particle sizes was broad.

Smoothness in feeding coarse powder to an accelerating tube and uniformity in dispersing the coarse powder in the accelerating tube were worse than those in Embodiment 9.

Comparative example 2

A classifying and pulverizing system (hereafter, fine powder production system D) identical to that in Comparative example 1 was employed, except that, the impact surface had a conical shape with an apex angle of 160°. Coarsely-pulverized powder identical to that prepared in Embodiment 9 was classified and pulverized at a throughput of 20.4 kg/H.

The resulting finely pulverized-and-classified product had a weight-average particle size of 8.5 μm. The distribution of particle sizes was broader than that in Embodiment 9.

The conditions for production and results of Embodiments 9 to 17 and Comparative examples 1 and 2 are listed below.

| Data No. | Fine powder production system | Slope of an accelerating tube | Structure of an impact surface | Distance from the impact surface |
|---|---|---|---|---|
| E9 | A | 0 | Cone with an apex angle of 160°, on a cylinder of 100 mm in diameter | 50 |

-continued

| | | | | |
|---|---|---|---|---|
| E10 | A | 15 | Cone with an apex angle of 160°, on a cylinder of 100 mm in diameter | 50 |
| E11 | A | 0 | Cone with an apex angle of 160°, on a cylinder of 100 mm in diameter | 100 |
| E12 | A | 0 | Cone with an apex angle of 160°, on a cylinder of 100 mm in diameter | 30 |
| E13 | A | 0 | Cone with an apex angle of 160°, on a cylinder of 100 mm in diameter | 220 |
| E14 | A | 0 | Cone with an apex angle of 160°, on a cylinder of 100 mm in diameter | 50 |
| E15 | A | 0 | Cone with an apex angle of 160°, on a cylinder of 150 mm in diameter | 50 |
| E16 | A | 0 | Conical projection with an apex angle of 160° on a cylinder of 100 mm in diameter | 50 |
| E17 | B | 0 | Conical shape with an apex angle of 160° on a cylinder of 100 mm in diameter | 50 |
| C1 | C | — | Plane of a cylinder | 50 |
| C2 | D | — | Cone with an apex angle of 160°, on a cylinder of 100 mm in diameter | 50 |

| DATA-No. | Structure of a pulverizing chamber | Throughput | Weight-average diameter | Pulverization efficiency ratio |
|---|---|---|---|---|
| E9 | Cylinder of 150 mm in diameter | 35.4 | 8.4 | 1.74 |
| E10 | Cylinder of 150 mm in diameter | 33.6 | 8.6 | 1.65 |
| Ell | Cylinder of 150 mm in diameter | 32.6 | 8.5 | 1.60 |
| E12 | Cylinder of 150 mm in diameter | 30.3 | 8.4 | 1.49 |
| E13 | Cylinder of 150 mm in diameter | 22.5 | 8.4 | 1.10 |
| E14 | Cylinder of 120 mm in diameter | 32.6 | 8.6 | 1.59 |
| E15 | Cylinder of 220 mm in diameter | 28.6 | 8.5 | 1.40 |
| E16 | Cylinder | 35.4 | 8.4 | 1.74 |

-continued

| | | | | |
|---|---|---|---|---|
| | of 150 mm in diameter | | | |
| E17 | Cylinder of 150 mm in diameter | 26.5 | 8.6 | 1.30 |
| C1 | Box-like shape | 16.4 | 8.4 | 0.80 |
| C2 | Box-like shape | 20.4 | 8.5 | 1.0 |

*E stands for Embodiment, and C, for Comparative example.

Compared with comparative examples that represent a toner production process in which toner is pulverized according to a conventional process, the embodiments of the toner production processes according to the present invention provide higher pulverization efficiency rates ranging from 1.1 to 1.74 with a weight-average diameter of a finely-pulverized product ranging from 8.4 to 8.6 μm. The distributions of particle sizes in the embodiments include smaller amounts of coarse and very fine powder than those in the comparative examples. The above table demonstrates that the toner production process of the present invention is superb.

A pneumatic impact pulverizer of the present invention pulverizes powder to be pulverized more efficiently than a conventional pneumatic impact pulverizer does. Furthermore, the pneumatic impact pulverizer of the present invention prevents the powder to be pulverized from fusing, coagulating, and getting coarser, and has an advantage of inhibiting the powder to be pulverized from abrading an impact member or an accelerating tube.

A fine powder production apparatus of the present invention permits high pulverization efficiency and produces a finely-pulverized product showing sharp distribution of particle sizes.

A process of producing toner for developing electrostatic images according to the present invention produces toner showing sharp distribution of particle sizes with high pulverization efficiency, inhibits toner from fusing, coagulating, and getting coarser, and in addition, localized abrasion of main parts of an apparatus by toner components. Thus, the process of the present invention realizes continuous stable production.

What is claimed is:

1. A pneumatic impact pulverizer, comprising:

an accelerating tube for carrying and accelerating powder to be pulverized with high-pressure gas; and a pulverizing chamber for pulverizing powder to be pulverized, a back end of said accelerating tube being provided with a pulverization powder feed port for feeding powder to be pulverized to said accelerating tube, said pulverizing chamber being equipped with an impact member having an impact surface opposed to an opening plane of an outlet of said accelerating tube, said pulverizing chamber having a side wall against which powder that has been pulverized by said impact member collides to further pulverize, and the closest distance, $L_1$, between said side wall and said impact member being shorter than the closest distance, $L_2$, between a front wall of said pulverizing chamber opposed to said impact surface and said impact member, wherein a high-pressure gas ejection nozzle is provided in said back end of said accelerating tube, with a tip of said high-pressure gas ejection nozzle located in the vicinity of an accelerating tube throat of said accelerating tube, and a pulverization powder feed port is formed around said high,pressure ejection nozzle.

2. A pneumatic impact pulverizer according to claim 1, wherein said accelerating tube is inclined to have a longitudinal slope ranging from 0° to 45° with respect to its longitudinal axis.

3. A pneumatic impact pulverizer according to claim 1, wherein said accelerating tube is inclined to have a longitudinal slope ranging from 0° to 20° with respect to its longitudinal axis.

4. A pneumatic impact pulverizer according to claim 1, wherein said accelerating tube is inclined to have a longitudinal slope ranging from 0° to 5° with respect to its longitudinal axis.

5. A pneumatic impact pulverizer according to claim 1, wherein said impact member has a projection at a central portion of said impact surface.

6. A pneumatic impact pulverizer according to claim 1, wherein said impact surface has an inclined plane having a slope $\theta_1$ smaller than 90° with respect to a longitudinal axis of said accelerating tube.

7. A pneumatic impact pulverizer according to claim 1, wherein said back end of said accelerating tube is provided with a pulverization powder feed nozzle.

8. A pneumatic impact pulverizer according to claim 10, wherein a tip of said pulverization powder feed nozzle is located at or in the vicinity of an accelerating tube throat of said accelerating tube.

9. A pneumatic impact pulverizer according to claim 8, wherein a pulverized powder discharge port for discharging the powder that has been pulverized is formed behind said impact surface of said impact member.

10. A pneumatic impact pulverizer according to claim 8, wherein a secondary gas intake is formed between said accelerating tube outlet and said pulverization powder feed port.

11. A pneumatic impact pulverizer according to claim 1, wherein said pulverizing chamber has a pulverized powder discharge port on a back wall opposite to the opening plane for discharging the powder that has been pulverized.

12. A fine powder production apparatus comprising a pneumatic classifying means and a pneumatic impact pulverizing means, said pneumatic classifying means having a powder feed pipe and a classifying chamber; a guide chamber communicating with said powder feed pipe formed in an upper part of said classifying chamber; a plurality of introduction louvers placed between said guide chamber and said classifying chamber so that powder is introduced from said guide chamber to said classifying member together with carrier air via apertures of said introduction louvers; a classifying plate having a swelled center installed on a bottom of said classifying chamber; a side wall of said classifying chamber provided with a classifying louver so that powder fed with carrier air is whirled in said classifying chamber together with air flowing in through apertures of said classifying louver and classified into fine powder and coarse powder by centrifugation; a fine powder discharge port for discharging the classified fine powder formed in the center of said classifying plate and connected to a fine powder discharge chute; and a coarse powder discharge opening for discharging the classified coarse powder formed along the outer circumference of said classifying plate;

first communicating means for feeding discharged coarse powder to said pneumatic impact pulverizing means; and said pneumatic impact pulverizing means having an accelerating tube for carrying and accelerating coarse powder fed with high-pressure gas and a pulverizing chamber for pulverizing coarse powder; a back end of said accelerating tube provided with a coarse powder feed port for feeding coarse powder to said accelerating tube; said pulverizing chamber equipped with an impact member having an impact surface opposed to an opening plane of an outlet of said accelerating tube; said pulverizing chamber having a side wall against which coarse powder of the pulverized powder that has been pulverized by said impact member collides to further pulverize; the closest distance, $L_1$, between said side wall and said impact member being shorter than the closest distance, $L_2$, between a front wall of said pulverizing chamber opposed to said impact surface and said impact member, wherein a high-pressure gas ejection nozzle is provided in said back end of said accelerating tube, and a pulverizing powder feed port is formed around said high-pressure ejection nozzle.

13. A fine powder production apparatus according to claim 12, wherein said accelerating tube is inclined to have a longitudinal slope ranging from 0° to 45° with respect to its longitudinal axis.

14. A fine powder production apparatus according to claim 12, wherein said accelerating tube is inclined to have a longitudinal slope ranging from 0° to 20° with respect to its longitudinal axis.

15. A fine powder production apparatus according to claim 12, wherein said accelerating tube is inclined to have a longitudinal slope ranging from 0° to 5° C. with respect to its longitudinal axis.

16. A fine powder production apparatus according to claim 12, wherein the classified coarse powder is reserved in a coarse powder discharge hopper to be fed to said pulverizing means.

17. A fine powder production apparatus according to claim 12, wherein a pulverized powder discharge port for discharging the powder to be pulverized is formed behind said impact surface of said impact member.

18. A fine powder production apparatus according to claim 12 further comprising second communicating means for feeding back powder pulverized by said pneumatic impact pulverizing means to said pneumatic classifying means.

19. A fine powder production apparatus according to claim 12, wherein said impact member has a projection of a center portion of said impact surface.

20. A fine powder production apparatus according to claim 12, wherein said impact surface of said impact member has an inclined plane having a slope $\theta_1$ smaller than 90° with respect to the longitudinal axis of said accelerating tube.

21. A fine powder production apparatus according to claim 12, wherein a tip of said high-pressure gas ejection nozzle is located in the vicinity of an accelerating tube throat of said accelerating tube.

22. A fine powder production apparatus according to claim 12, wherein said back end of said accelerating tube is provided with a pulverization powder feed nozzle.

23. A fine powder production apparatus according to claim 22, wherein a tip of said pulverization powder feed nozzle is located at or in the vicinity of said accelerating tube throat of said accelerating tube.

24. A fine powder production apparatus according to claim 12, wherein a pulverized powder discharge port for discharging the powder that has been pulverized is formed behind said impact surface of said impact member.

25. A fine powder production apparatus according to claim 23, wherein a secondary gas intake is formed between said accelerating tube outlet and said pulverization powder feed port.

26. A process for producing toner using pneumatic classifying means and pneumatic impact pulverizing means, the pneumatic classifying means having a powder feed pipe and a classifying chamber; a guide chamber communicating with the powder feed pipe formed in an upper part of the classifying chamber; a plurality of introduction louvers placed between the guide chamber and the classifying chamber so that powder is introduced from the guide chamber to the classifying chamber together with carrier air via apertures in the introduction louvers; a classifying plate having a swelled center installed on a bottom of the classifying chamber; a side wall of the classifying chamber provided with a classifying louver so that powder fed with carrier air is whirled in the classifying chamber together with air flowing through apertures in the classifying louver and classified into fine powder and coarse powder by means of centrifugation; a fine powder discharge port for discharging the classified fine powder formed in a center of the classifying plate and connected to a fine powder discharge chute; a coarse powder discharge opening for discharging the classified coarse powder formed along the outer circumference of the classifying plate;

the pneumatic impact pulverizing means having an accelerating tube for carrying and accelerating coarse powder fed with high-pressure gas and a pulverizing chamber for further pulverizing coarse powder; a back end of the accelerating tube provided with a coarse powder feed port for feeding coarse powder to the accelerating tube; the pulverizing chamber equipped with an impact member having an impact surface opposed to an opening plane of an outlet of the accelerating tube; the pulverizing chamber having a side wall against which the pulverized powder of coarse powder that has been pulverized with the impact member collides to further pulverize; the closest distance, $L_1$, between the side wall and the impact member is shorter than the closest distance, $L_2$, between a front wall of the pulverizing chamber opposed to the impact surface and the impact member; and in the pulverizing chamber, pulverization of coarse powder and further pulverization of the pulverized coarse powder are carried out with the impact surface of the impact member and the side wall, said process comprising the steps of:

melting and kneading a mixture containing at least a binder resin and a coolant;

cooling the kneaded mixture;

pulverizing the cooled mixture using a pulverizer to produce a pulverized mixture;

classifying the pulverized mixture into coarse powder and fine powder using the pneumatic classifying means;

feeding the coarse powder to the pneumatic impact pulverizing means;

further pulverizing the classified coarse powder using the pneumatic impact pulverizing means and producing a fine powder material;

feeding the pulverized powder back to the pneumatic classifying means;

classifying the fine powder material using the pneumatic classifying means and producing fine powder; and using the classified fine powder to produce toner for developing electrostatic images.

27. A process according to claim 26, wherein the accelerating tube is inclined to have a longitudinal slope ranging from 0° to 45° with respect to a longitudinal axis.

28. A process according to claim 26, wherein the accelerating tube is inclined to have a longitudinal slope ranging from 0° to 20° with respect to a longitudinal axis.

29. A process according to claim 26, wherein the accelerating tube is inclined to have a longitudinal slope ranging from 0° to 5° with respect to a longitudinal axis.

30. A process according to claim 27, further comprising the step of feeding the pulverized coarse powder back to the pneumatic classifying means.

31. A process according to claim 26, wherein the impact member has a projection at a central portion of the impact surface.

32. A process according to claim 26 wherein said impact surface of the impact member has an inclined plane having a slope $\theta_1$ smaller than 90° with respect to a longitudinal axis of the accelerating tube.

33. A process according to claim 26 wherein the back end of the accelerating tube is provided with a high-pressure gas ejection nozzle.

34. A process according to claim 33, wherein a tip of the high-pressure gas ejection nozzle is located in the vicinity of an accelerating tube throat of the accelerating tube.

35. A process according to claim 33 wherein a pulverization powder feed port is formed around the high-pressure gas ejection nozzle.

36. A process according to claim 26 wherein the back end of said accelerating tube is provided with a pulverization powder feed nozzle.

37. A process according to claim 36, wherein a tip of said pulverization powder feed nozzle is located at or in the vicinity of the accelerating tube throat of the accelerating tube.

38. A process according to claim 26 wherein a pulverized powder discharge port for discharging the powder that has been pulverized is formed behind the impact surface of the impact member.

39. A process according to claim 37 wherein a secondary gas intake is formed between the accelerating tube outlet and the pulverization powder feed port.

40. A process according to claim 26, wherein the pulverizing chamber has a pulverized powder discharge port on its back wall opposite to the opening plane for discharging the powder that has been pulverized.

41. A fine powder production apparatus comprising:

pneumatic classifying means, and pneumatic impact pulverizing means, with said pneumatic classifying means having a classifying chamber for classifying powder into at least fine powder and coarse powder;

first communicating means for feeding discharged coarse powder to said pneumatic impact pulverizing means; and said pneumatic impact pulverizing means having an accelerating tube for carrying and accelerating coarse powder fed with high-pressure gas and a pulverizing chamber for pulverizing coarse powder, a back end of said accelerating tube provided with a coarse powder feed port for feeding coarse powder to said accelerating tube, said pulverizing chamber equipped with an impact member having an impact surface opposed to an opening plane of an outlet of said accelerating tube, said pulverizing chamber having a side wall against which coarse powder of the pulverized powder that has been pulverized by said impact member collides to further pulverize, with the closest distance, $L_1$, between said side wall and said impact member being shorter than the closest distance, $L_2$, between a front wall of said pulverizing chamber opposed to said impact surface and said impact member, wherein a high-pressure gas ejection nozzle is provided in said back end of said accelerating tube, and a pulverization powder feed port is formed around said high-pressure ejection nozzle, and a tip of said high-pressure gas ejection nozzle is located in the vicinity of an accelerating tube throat of said accelerating tube.

42. A fine powder production apparatus according to claim 41, wherein said accelerating tube is inclined to have a longitudinal slope ranging from 0° to 45° with respect to its longitudinal axis.

43. A fine powder production apparatus according to claim 41, wherein said accelerating tube is inclined to have a longitudinal slope ranging from 0° to 20° with respect to its longitudinal axis.

44. A fine powder production apparatus according to claim 41, wherein said accelerating tube is inclined to have a longitudinal slope ranging from 0° to 5° C with respect to its longitudinal axis.

45. A fine powder production apparatus according to claim 41, wherein the classified coarse powder is reserved in a coarse powder discharge hopper to be then fed to said pulverizing means.

46. A fine powder production apparatus according to claim 41, wherein a pulverized powder discharge port for discharging the powder to be pulverized is formed behind said impact surface of said impact member.

47. A fine powder production apparatus according to claim 41, further comprising second communicating means for feeding back powder pulverized by said pneumatic impact pulverizing means to said pneumatic classifying means.

48. A fine powder production apparatus according to claim 41, wherein said impact member has a projection at a central portion of said impact surface.

49. A fine powder production apparatus according to claim 41, wherein said impact surface of said impact member has an inclined plane having a slope $\theta_1$ smaller than 90° with respect to the longitudinal axis of said accelerating tube.

50. A fine powder production apparatus according to claim 41, wherein said back end of said accelerating tube is provided with a pulverization powder feed nozzle.

51. A fine powder production apparatus according to claim 41, wherein a pulverized powder discharge port for discharging the powder to be pulverized is formed behind said impact surface of said impact member.

52. A fine powder production apparatus according to claim 41, wherein a secondary gas intake is formed between said accelerating tube outlet and said pulverization powder feed port.

53. A pneumatic impact pulverizer, comprising:

an accelerating tube for carrying and accelerating powder to be pulverized with high-pressure gas; and a pulverizing chamber for pulverizing powder to be pulverized, a back end of said accelerating tube being provided with a pulverization powder feed port for feeding powder to be pulverized to said accelerating tube, said pulverizing chamber being equipped with an impact member having an impact surface opposed to an opening plane of an outlet of said accelerating tube, said pulverizing chamber having a side wall against which powder that has been pulverized by said impact member collides to further pulverize, and the closest distance, $L_1$, between said side wall and said impact member being shorter than the closest distance, $L_2$, between a front wall of said pulverizing chamber opposed to said impact surface and said impact member, wherein a high-pressure gas ejection nozzle is provided in said back end of said accelerating tube, and a pulverization powder feed port is formed around said high-pressure ejection nozzle.

54. A pneumatic impact pulverizer according to claim 53, wherein said accelerating tube is inclined to have a longitudinal slope ranging from 0° to 45° with respect to its longitudinal axis.

55. A pneumatic impact pulverizer according to claim 53, wherein said accelerating tube is inclined to have a longitudinal slope ranging from 0° to 20° with respect to its longitudinal axis.

56. A pneumatic impact pulverizer according to claim 53, wherein said accelerating tube is inclined to have a longitudinal slope ranging from 0° to 5° with respect to its longitudinal axis.

57. A pneumatic impact pulverizer according to claim 53, wherein said impact member has a projection at a central portion of said impact surface.

58. A pneumatic impact pulverizer according to claim 53, wherein said impact surface has an inclined plane having a slope $\theta_1$ smaller than 90° with respect to the longitudinal axis of said accelerating tube.

59. A pneumatic impact pulverizer according to claim 53, wherein said back end of said accelerating tube is provided with a high-pressure gas ejection nozzle.

60. A pneumatic impact pulverizer according to claim 59, wherein a tip of said high-pressure gas ejection nozzle is located in the vicinity of an accelerating tube throat of said accelerating tube.

61. A pneumatic impact pulverizer according to claim 53, wherein said back end of said accelerating tube is provided with a pulverization powder feed nozzle.

62. A pneumatic impact pulverizer according to claim 61, wherein a tip of said pulverization powder feed nozzle is located at or in the vicinity of an accelerating tube throat of said accelerating tube.

63. A pneumatic impact pulverizer according to claim 62, wherein a pulverized powder discharge port for discharging the powder to be pulverized that has been pulverized is formed behind said input surface of said impact member.

64. A pneumatic impact pulverizer according to claim 62, wherein a secondary gas intake is formed between said accelerating tube outlet and said pulverization powder feed port.

65. A pneumatic impact pulverizer according to claim 53, wherein said pulverizing chamber has a pulverized powder discharge port in a back wall opposite to the opening plane for discharging the powder that has been pulverized.

* * * * *

UNITED STATES PATENT AND TRADEMARK OFFICE

CERTIFICATE OF CORRECTION

PATENT NO. : 5,577,670 Page 1 of 2

DATED : November 26, 1996

INVENTOR(S) : Omata et al.

It is certified that error appears in the above-indentified patent and that said Letters Patent is hereby corrected as shown below:

On title page

[56] REFERENCES CITED:

FOREIGN PATENT DOCUMENTS, "1148740 6/1989 Japan
1254266 10/1989 Japan" should read --1-148740 6/1989 Japan
1-254266 10/1989 Japan--.

COLUMN 2:

Line 18, "out" should read --but--.

COLUMN 9:

Line 51, "or two," should read --two,--.

COLUMN 13:

Line 57,"a-toner" should read --a toner--.

COLUMN 14:

Line 7, "Comohomers" should read --Comonomers--.

COLUMN 17:

Line 2, "power" should read --powder--.

COLUMN 22:

Line 13, "high,pressure" should read --high-pressure--.
Line 35, "claim 10," should read --claim 7,--.

UNITED STATES PATENT AND TRADEMARK OFFICE

CERTIFICATE OF CORRECTION

PATENT NO. : 5,577,670 Page 2 of 2

DATED : November 26, 1996

INVENTOR(S) : Omata et al.

It is certified that error appears in the above-indentified patent and that said Letters Patent is hereby corrected as shown below:

COLUMN 23:

Line 60, "center" should read --central--.

COLUMN 26:

Line 34, "5°C" should read --5°--.

Signed and Sealed this

Twenty-second Day of July, 1997

Bruce Lehman

*Attest:*

BRUCE LEHMAN

*Attesting Officer*

*Commissioner of Patents and Trademarks*